US008587623B2

(12) United States Patent
Sudo et al.

(10) Patent No.: US 8,587,623 B2
(45) Date of Patent: Nov. 19, 2013

(54) PRINTER

(75) Inventors: Shinichi Sudo, Chiba (JP); Kouji Kawaguchi, Chiba (JP); Akio Naito, Chiba (JP)

(73) Assignee: Seiko Instruments Inc. (JP)

( * ) Notice: Subject to any disclaimer, the term of this patent is extended or adjusted under 35 U.S.C. 154(b) by 245 days.

(21) Appl. No.: 12/930,322

(22) Filed: Jan. 4, 2011

(65) Prior Publication Data

US 2011/0170904 A1 Jul. 14, 2011

(30) Foreign Application Priority Data

Jan. 8, 2010 (JP) ..... 2010-003350

(51) Int. Cl.
*B41J 2/32* (2006.01)
*B41J 25/304* (2006.01)
*G01D 15/10* (2006.01)

(52) U.S. Cl.
USPC ..... 347/197; 347/220

(58) Field of Classification Search
USPC ..... 347/197, 220, 222
See application file for complete search history.

(56) References Cited

U.S. PATENT DOCUMENTS 5,694,159 A 12/1997 Kajiya et al. ..... 347/197
5,697,714 A 12/1997 Onuki et al. ..... 400/120.16
2010/0143018 A1* 6/2010 Kawaguchi ..... 400/621

FOREIGN PATENT DOCUMENTS

JP 2000118060 5/2000
JP 2004209722 7/2004

* cited by examiner

*Primary Examiner* — Omar Rojas
(74) *Attorney, Agent, or Firm* — Adams & Wilks

(57) ABSTRACT

A printer has first and second units configured for attachment/detachment relative one another and for supporting one of a recording head and a platen roller. The first unit has spaced wall portions provided with first and second recesses. The second unit has engagement pins that detachably fit into respective ones of the first recesses, a latch member that undergoes rotation about an axial line of the engagement pins and has a pair of lock pins that detachably fit into respective ones of the second recesses after the engagement pins are fitted in the first recesses, a biasing member biasing the latch member in a first direction of detachably fitting the lock pins in the second recesses, and a release member for moving the lock pins in a second direction opposite to the first direction to detach the lock pins from the second recesses.

19 Claims, 22 Drawing Sheets

PRINTER

BACKGROUND OF THE INVENTION

1. Field of the Invention

The present invention relates to a printer in which a platen roller and a recording head are separably combined with each other.

2. Description of the Related Art

As conventionally known printers, there are given known printers in which a recording head and a platen roller, which are held in contact with the recording head, are provided inside a casing, and in which the recording head performs recording on a recording sheet sent out by the platen roller. In the printers of this type, for example, when setting the recording sheet or dealing with jamming, or when maintaining or replacing the recording head, the platen roller, and the like, workability is poor in a case where the recording head and the platen roller are held in contact with each other inside the casing.

In view of this, a printer configuration is desired in which the recording head and the platen roller can be spaced from each other so as to be exposed to an outside of the casing. For this reason, there are known separation-type printers which include a main unit and a detachable unit separably combined with each other, and in which a recording head is provided to one of the units and a platen roller is provided to the other of the units.

According to the separation-type printers, the recording head and the platen roller can be combined with each other under an appropriate press-contact state when the detachable unit is combined with the main unit, and the recording head and the platen roller can be spaced from each other to be exposed to the outside when the detachable unit is separated from the main unit. Therefore, the separation-type printers described above are easy to use and are excellent in workability when performing the above-mentioned various operations.

Incidentally, in the case of the separation-type printers, it is important to reliably combine the main unit and the detachable unit together with less looseness, or to perform smooth attachment/detachment operations. Thus, as printers meeting such a demand, there is known a printer adopting an arm-type locking method (see Japanese Patent Application Laid-open No. 2000-118060).

The printer includes a body frame provided with a thermal head, and a cover frame provided with a platen roller, and has a configuration in which the cover frame is separably combined with the body frame through opening/closing operation of the cover frame.

A hook-shaped lock lever is pivotably attached to the cover frame, the hook-shaped lock lever having a tip end serving as an engagement portion. Meanwhile, the body frame is provided with a lock pin on which the engagement portion of the lock lever is engaged.

According to the printer thus configured, when the lock lever is pivoted so that the engagement portion is engaged onto the lock pin, it is possible to reliably combine the body frame and the cover frame with each other, and to bring the thermal head and the platen roller into press-contact with each other. Further, when the lock lever is pivoted in an opposite direction so that the engagement portion is disengaged from the lock pin, it is possible to separate the body frame and the cover frame from each other.

In this way, with use of the lock lever, it is possible to reliably combine the body frame and the cover frame with each other, and to perform smooth attachment/detachment operation of the cover frame.

However, in the above-mentioned printer adopting the conventional arm-type locking method, in order to engage the engagement portion onto the lock pin, the lock lever needs to be provided to the cover frame while protruding to the body frame side. Therefore, the lock lever projects outward further from the cover frame in a direction in which the body frame and the cover frame are combined with each other, and hence miniaturization of the entire printer is hindered.

Further, the lock lever is attached onto a side surface of the cover frame, and is arranged on any one of the inside and the outside of a wall of the body frame when the cover frame and the body frame are combined with each other. Accordingly, a size in a width direction of the printer (in a width direction of the platen roller) is increased by at least a thickness of the lock lever. Even in this respect, the miniaturization is further hindered.

Still further, the lock lever protrudes outward further from the cover frame, and hence fingertips easily touch the lock lever as a protrusion, which is susceptible to improvement in terms of safety.

SUMMARY OF THE INVENTION

The present invention has been made in view of the above-mentioned circumstances, and has an object to provide a printer excellent in safety and capable of reliably combining a main unit and a detachable unit with each other, performing smooth attachment/detachment operation of the detachable unit, easily achieving miniaturization, and suppressing interference with fingertips during the attachment/detachment operation.

The present invention provides the following techniques for solving the above-mentioned problems.

(1) The present invention provides a printer in which a recording head and a platen roller are separably combined with each other. The printer includes: a main unit which includes opposed walls opposed to each other, and supports one of the recording head and the platen roller; and a detachable unit which is combined with the main unit so as to be attached to/detached from the main unit freely, and supports another of the recording head and the platen roller. The detachable unit includes: an engagement pin protruding along an axial line which is non-coaxial and parallel with respect to a platen shaft of the platen roller; and a lock pin protruding in a direction parallel to the engagement pin, and being movable relative to the engagement pin in a virtual plane orthogonal to the platen shaft. The opposed walls each include: a first recess which allows the engagement pin to be fitted in the first recess detachably, and arranges the recording head and the platen roller so that the recording head and the platen roller are opposed to each other in a contact state; and a second recess which allows the lock pin to be fitted in the second recess detachably after the engagement pin is fitted in the first recess, the engagement pin being incapable of being detached from the first recess when the lock pin is fitted in the second recess, and being capable of being detached from the first recess after the lock pin is detached from the second recess.

In the printer according to the present invention, in the case where the detachable unit is mounted on and combined with the main unit, first, the engagement pin is inserted and fitted into the first recess formed in each of the opposed walls. Next, the lock pin is moved relative to the engagement pin, and is inserted and fitted into the second recess formed in each of the opposed walls. In this way, mounting of the detachable unit is completed, and the engagement pin can be set in the first recess so as not to be detached from the first recess.

At this time, the recording head and the platen roller, which are respectively supported by both of the detachable and main units, can be arranged to be opposed to each other in the contact state. In other words, the recording head and the platen roller can be set so as to be capable of performing printing.

In particular, when printing is performed while both of the detachable and main units are combined, even if an external force is applied to the platen roller from the recording head, the recording sheet, or the like, the external force is unlikely to be transmitted to the lock pin and the engagement pin non-coaxial with respect to the platen shaft. Thus, it is possible to prevent the engagement pin and the lock pin from being detached from the first recess and the second recess due to an influence of the external force. Therefore, it is possible to securely combine the detachable unit with the main unit with high reliability. Accordingly, it is possible to stably combine the recording head and the platen roller with each other, and hence stable printing can be performed.

On the other hand, in the case where the detachable unit is separated from the main unit, the lock pin is moved in a direction opposite to the direction of the above-mentioned case, and is detached from the second recess. Next, while the engagement pin is detached from the first recess, the detachable unit is spaced from the main unit. In this way, it is possible to separate both the units from each other by canceling the combination thereof, and to separate the recording head and the platen roller from each other.

As described above, with only simple operations of fitting/detachment of the engagement pin with respect to the first recess and fitting/detachment of the lock pin with respect to the second recess due to the movement of the lock pin, the attachment/detachment operation of the detachable unit can be performed smoothly. Thus, the main unit and the detachable unit can be combined quickly, or the combination of both units can be cancelled by separating both units from each other quickly.

Further, unlike the case of using the conventional lock lever protruding largely outward, the detachable unit is provided with only the engagement pin and the lock pin protruding slightly in the direction parallel to the platen shaft. Thus, fingertips are unlikely to interfere with the engagement pin and the lock pin during the attachment/detachment operation of the detachable unit, and hence the safety is more excellent compared with that of the conventional example.

Further, the engagement pin and the lock pin are respectively fitted in the first recess and the second recess formed in each of the opposed walls of the main unit. Therefore, unlike the case of using the conventional lock lever, the size of the lateral width of the detachable unit (lateral width along the platen shaft) can be reliably contained in an interval of the opposed walls. Thus, the entire printer can be miniaturized easily.

(2) According to the present invention, in the printer, the detachable unit includes: a biasing member for moving the lock pin in a direction of biasing and fitting the lock pin into the second recess; and a release member for moving the lock pin in a direction opposite to the direction of biasing the lock pin, to thereby detach the lock pin from the second recess.

In the printer according to the present invention, the lock pin is biased by the biasing member, and hence, after the engagement pin is fitted into the first recess, the lock pin can be led and fitted into the second recess. Therefore, it is possible to perform a mounting operation of the detachable unit smoothly and efficiently. Further, after the mounting of the detachable unit, by the bias of the biasing member, the lock pin is unlikely to move in a direction in which the lock pin is detached from the second recess. Therefore, it is possible to prevent the lock pin from being detached from the second recess unintentionally, and to render the combination of the main unit and the detachable unit reliable.

On the other hand, in the case where the detachable unit is separated from the main unit, with use of the release member, the lock pin is detached from the second recess with a force against the biasing member. As a result, it is possible to separate the detachable unit from the main unit.

(3) According to the present invention, in the printer, the detachable unit includes a latch member rotating freely about the axial line of the engagement pin, and the lock pin is formed integrally with the latch member, and is moved to rotate along with rotation of the latch member.

In the printer according to the present invention, when the latch member is rotated about the axial line of the engagement pin after the engagement pin is fitted into the first recess, it is possible to rotate and move the lock pin relative to the engagement pin, and to fit the lock pin into the second recess. Further, when the latch member is rotated in the opposite direction, it is possible to detach the lock pin from the second recess.

In particular, with a simple configuration in which the latch member is merely rotated, the lock pin can be moved relative to the engagement pin. Thus, the configuration can be simplified and the parts count can be reduced.

(4) According to the present invention, in the printer, the detachable unit includes an auxiliary pin protruding in the direction parallel to the engagement pin, and the opposed walls each include a third recess which is opened in the same direction as an opening direction of the first recess and allows the auxiliary pin to be fitted in the third recess detachably.

In the printer according to the present invention, the first recess and the third recess are opened in the same direction, and hence the auxiliary pin can be fitted into the third recess at the same timing when the engagement pin is fitted into the first recess. After that, the lock pin is fitted into the second recess. As a result, the detachable unit is mounted.

In particular, in addition to the engagement pin and the lock pin, the auxiliary pin is fitted in the third recess. Therefore, the detachable unit can be combined with the main unit more strongly. Therefore, even if some external force is applied to the detachable unit, looseness and the like are unlikely to occur. Therefore, more stable printing can be performed.

According to the printer of the present invention, it is possible to reliably combine the main unit and the detachable unit with each other, and to perform smooth attachment/detachment operation of the detachable unit. Further, miniaturization is easily achieved, and fingertips are unlikely to interfere with the engagement pin and the lock pin during the attachment/detachment operation. Thus, the printer according to the present invention is excellent in safety.

DETAILED DESCRIPTION OF THE PREFERRED EMBODIMENT

Hereinafter, an embodiment according to the present invention is described with reference to FIGS. 1 to 24. In this embodiment, a thermal printer is described as an example of a printer.

Figure 1:
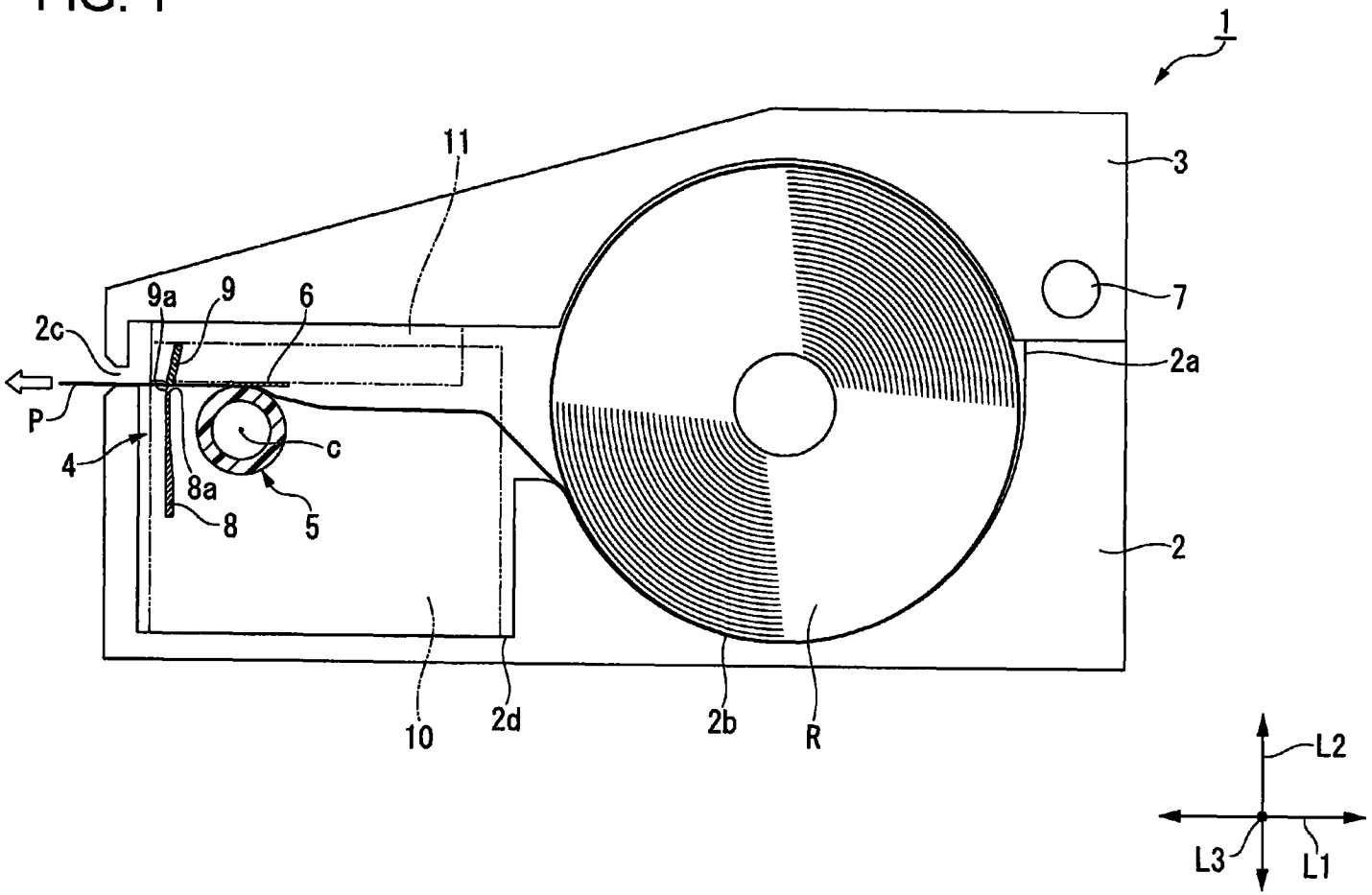
FIG. 1 is a cross-sectional view of a thermal printer according to an embodiment of the present invention, with an open/close door closed.
Figure 2:
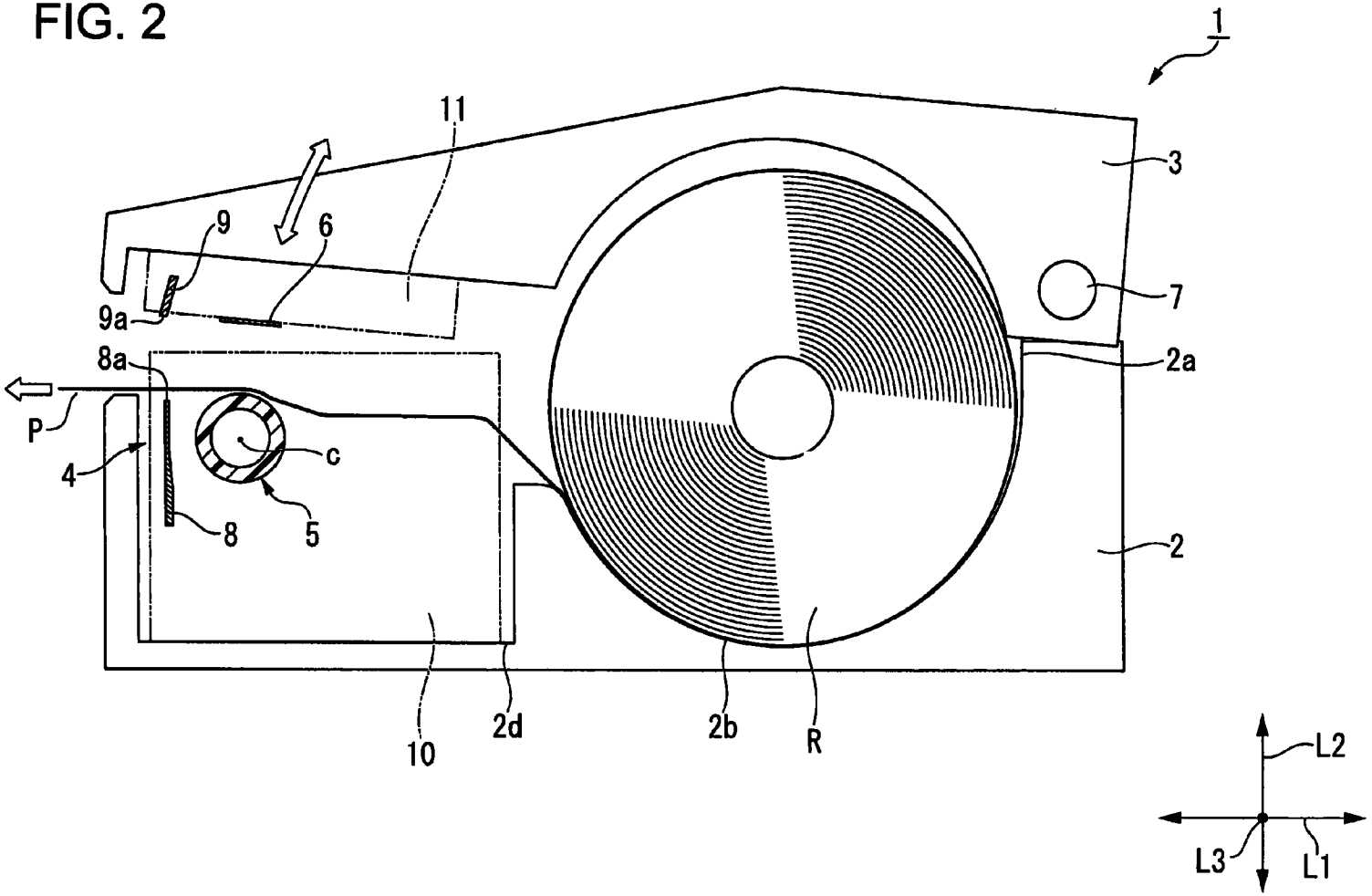
FIG. 2 is a cross-sectional view of the thermal printer with the open/close door opened from the state illustrated in FIG. 1.

As illustrated in FIGS. 1 and 2, the thermal printer according to this embodiment is a so-called clamshell printer capable of performing printing on a recording sheet P pulled out of a paper roll R, appropriately cutting the recording sheet P, and utilizing the cut piece of the recording sheet P as a ticket, a sales check, etc.

The thermal printer mainly includes a casing 2, an open/close door 3 provided so as to be opened/closed with respect to the casing 2, a cutter mechanism 4, a platen roller 5, and a thermal head (recording head) 6.

FIG. 1 is a cross-sectional view of a thermal printer 1 with the open/close door 3 closed. FIG. 2 is a cross-sectional view of the thermal printer 1 with the open/close door 3 opened.

Further, in this embodiment, in the state illustrated in FIG. 1, the left side, right side, upper side, and lower side with respect to the drawing sheet are defined as a front side, a back side, an upper side, and a lower side, respectively. It is assumed that the recording sheet P is fed in fore-and-aft directions L1. Further, it is also assumed that a direction orthogonal to the fore-and-aft directions L1 and up-and-down directions L2 is right-and-left directions L3.

The casing 2 is molded with plastic or a metal material, and is formed in a box-shape with an insertion port 2*a* opened in an upper portion. In the casing 2, a mounting board 2*b* for mounting the paper roll R inserted through the insertion port 2*a* is provided. The mounting board 2*b* is formed so as to be curved in an arcuate shape, and allows the paper roll R in a cylindrical shape to be mounted thereon stably.

The open/close door 3 coupled so as to be opened/closed via a hinge portion 7 is attached to the upper portion of the casing 2. The open/close door 3 is designed so as to be opened/closed within a predetermined angle range from the closed state illustrated in FIG. 1 to the opened state illustrated in FIG. 2. Then, as illustrated in FIG. 2, when the open/close door 3 is opened, the insertion port 2*a* appears, and thus, the paper roll R can be inserted in the casing 2 or taken out of the casing 2.

Further, as illustrated in FIG. 1, the thermal printer 1 is designed so that a slight gap is formed between the tip end of the open/close door 3 and the casing 2 when the open/close door 3 is closed. The recording sheet P fed from the inside of the casing 2 is to be pulled out, utilizing the gap. That is, the gap functions as a discharge port 2*c* of the recording sheet P.

The open/close door 3 is designed so as to be locked with respect to the casing 2 automatically with a lock mechanism (not shown) when the open/close door 3 is closed. The lock mechanism can be unlocked with one-touch from outside of the casing 2, and hence, the open/close door 3 can be opened quickly.

The cutter mechanism 4 includes a main unit (first unit) 10 which supports the platen roller 5 and incorporates a movable blade 8 capable of being slid, and a detachable unit (second unit) 11 which supports the thermal head 6, incorporates a fixed blade 9 for cutting the recording sheet P while sandwiching the recording sheet P together with the movable blade 8 during the slide of the movable blade 8, and is separably combined with the main unit 10.

The main unit 10 of both the units 10, 11 is provided on the casing 2 side. Specifically, the main unit 10 is fixed in an accommodating chamber 2*d* formed in front of the mounting board 2*b* on which the paper roll R is to be mounted. In FIGS. 1 and 2, the movable blade 8 and the platen roller 5 are illustrated in representative form.

On the other side, the detachable unit 11 is provided on an inner surface on a tip end side of the open/close door 3. Therefore, the detachable unit 11 moves along with the opening/closing operation of the open/close door 3, and thus, is combined with the main unit 10 or separated from the main unit 10.

FIGS. 1 and 2 illustrate the fixed blade 9 and the thermal head 6 in representative form.

Figure 3:
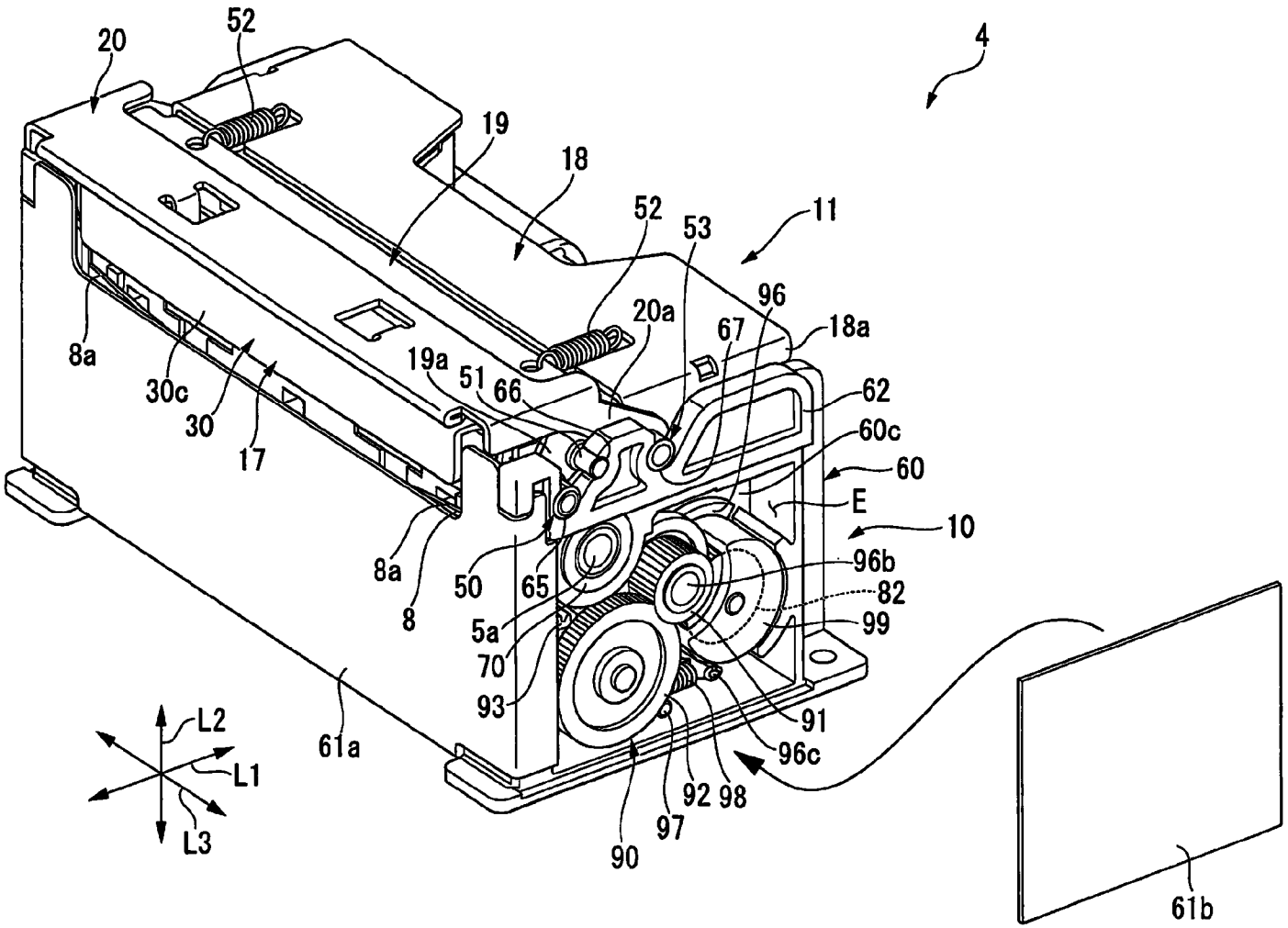
FIG. 3 is a perspective view illustrating a state in which a detachable unit is mounted on a main unit.
Figure 4:
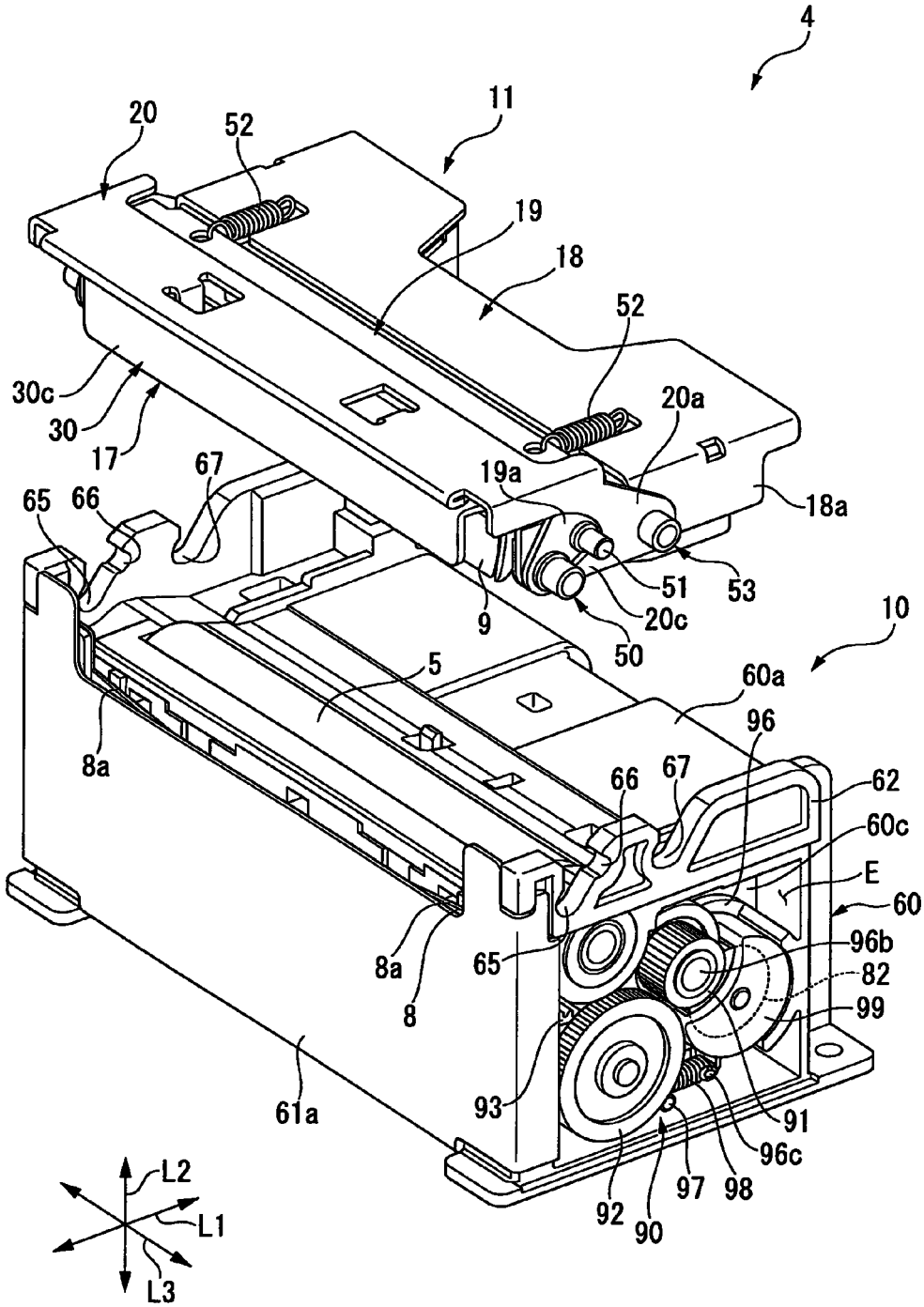
FIG. 4 is a perspective view illustrating a state in which the detachable unit is separated from the state illustrated in FIG. 3, with a side cover of the main unit removed.
Figure 5:
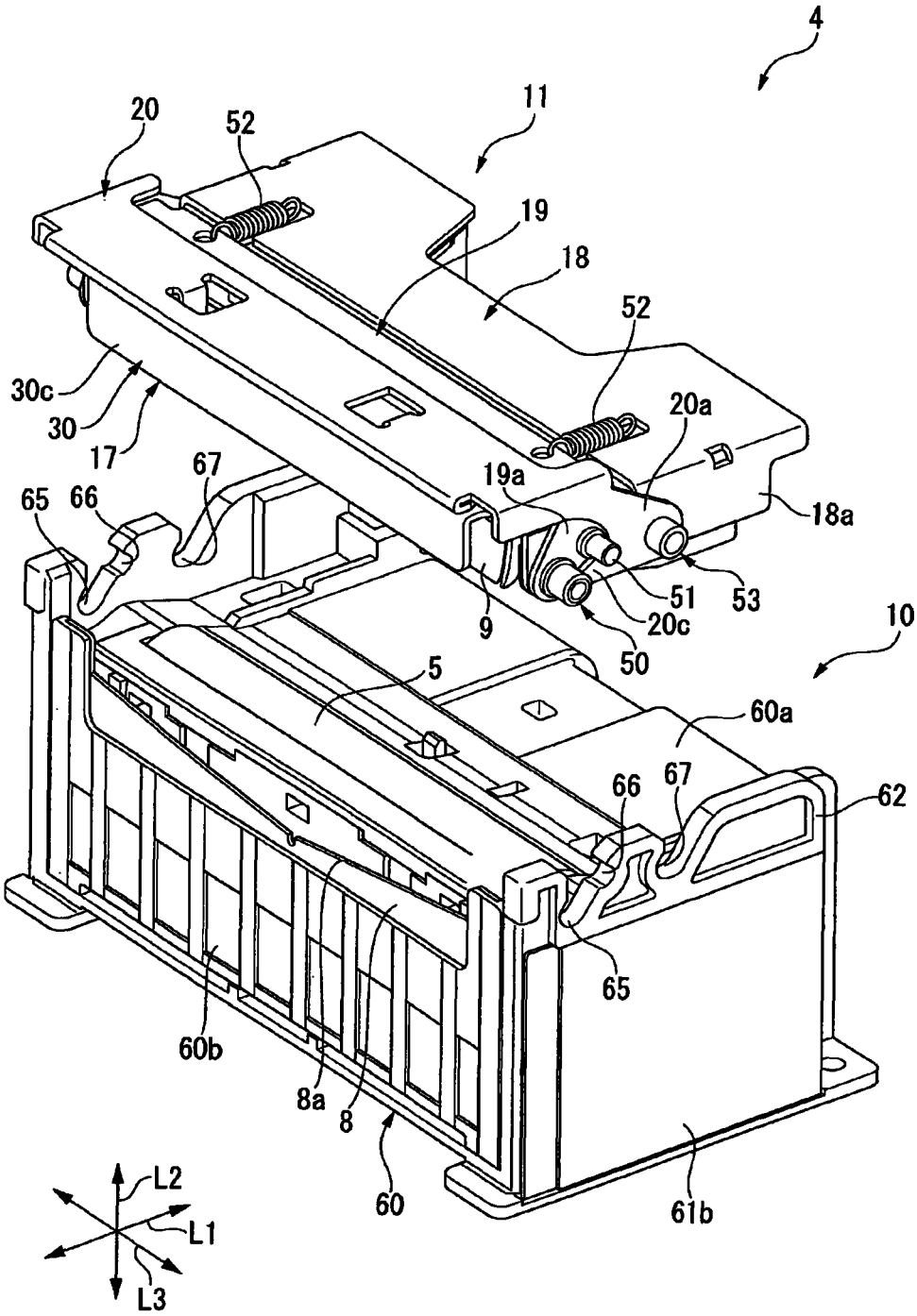
FIG. 5 is a perspective view illustrating a state in which the detachable unit is separated from the state illustrated in FIG. 3, with a front cover of the main unit removed.

The main unit 10 and the detachable unit 11 are to be combined as illustrated in FIG. 3 when the open/close door 3 is closed. This allows the main unit 10 to be combined with the detachable unit 11 so that the movable blade 8 and the fixed blade 9 are placed to be opposed to each other with the recording sheet P sandwiched therebetween as illustrated in FIG. 1, and the thermal head 6 is held in contact with the platen roller 5 under an appropriate contacting pressure. Further, when the open/close door 3 is opened, the detachable unit 11 is separated from the main unit 10, as illustrated in FIGS. 4 and 5. This allows the movable blade 8 and the fixed blade 9 to be moved away from each other and allows the thermal head 6 to be separated from the platen roller 5.

FIG. 3 is a perspective view illustrating a state in which the detachable unit 11 is mounted on the main unit 10. FIG. 4 is a perspective view illustrating a state in which a side cover 61*b* of the main unit is removed, and illustrating a state in which the detachable unit 11 is separated from the state illustrated in FIG. 3. FIG. 5 is a perspective view illustrating a state in which a front cover 61*a* of the main unit is removed, and illustrating a state in which the detachable unit 11 is separated from the state illustrated in FIG. 3.

Hereinafter, the configurations of both units 10, 11 are described in detail in the order of the detachable unit 11 and the main unit 10.

(Detachable Unit)

First, the detachable unit 11 moves to rotate about the hinge portion 7 along with the opening/closing operation of the open/close door 3, as described above. However, the detachable unit 11 moves close to and away from the main unit 10 in the sliding direction (up-and-down directions L2) of the movable blade 8 immediately before being combined with the main unit 10 and immediately after being separated from the main unit 10.

As illustrated in FIGS. 6 to 9, the detachable unit 11 according to this embodiment includes the thermal head 6, a head support frame 15 supporting the thermal head 6, the fixed blade 9 placed on a downstream side in a conveying direction of the recording sheet P with respect to the thermal head 6, a fixed blade holder 16 holding the fixed blade 9, a holder support frame (holder support member) 17 supporting the fixed blade holder 16 movably, a fixed blade holder cover 18 covering a back side of the holder support frame 17, a latch cover (latch member) 19 covering a front side of the holder support frame 17, and a release cover (release member) 20 further covering the latch cover 19.

Figure 6:
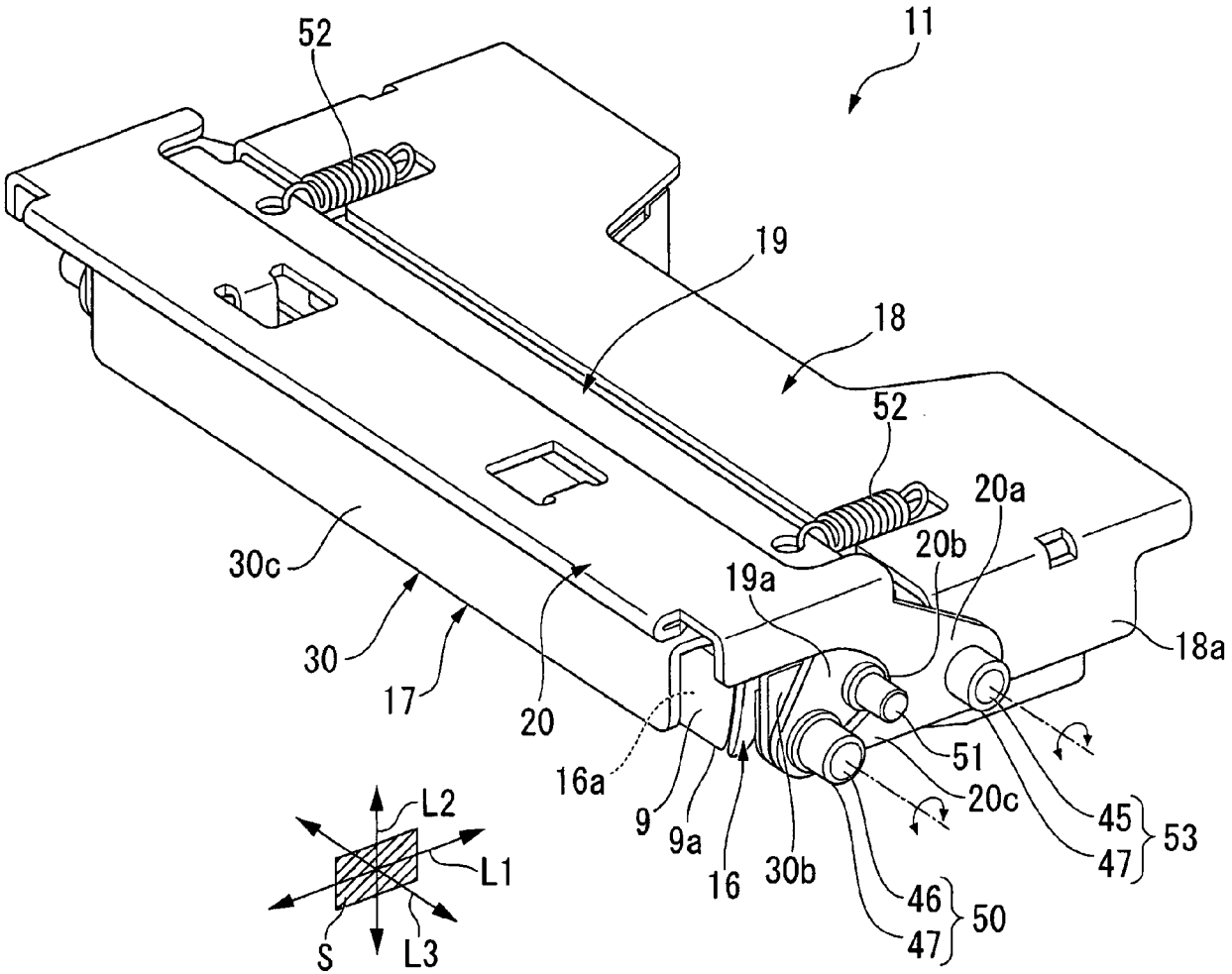
FIG. 6 is a perspective view of an outer appearance of the detachable unit.
Figure 7:
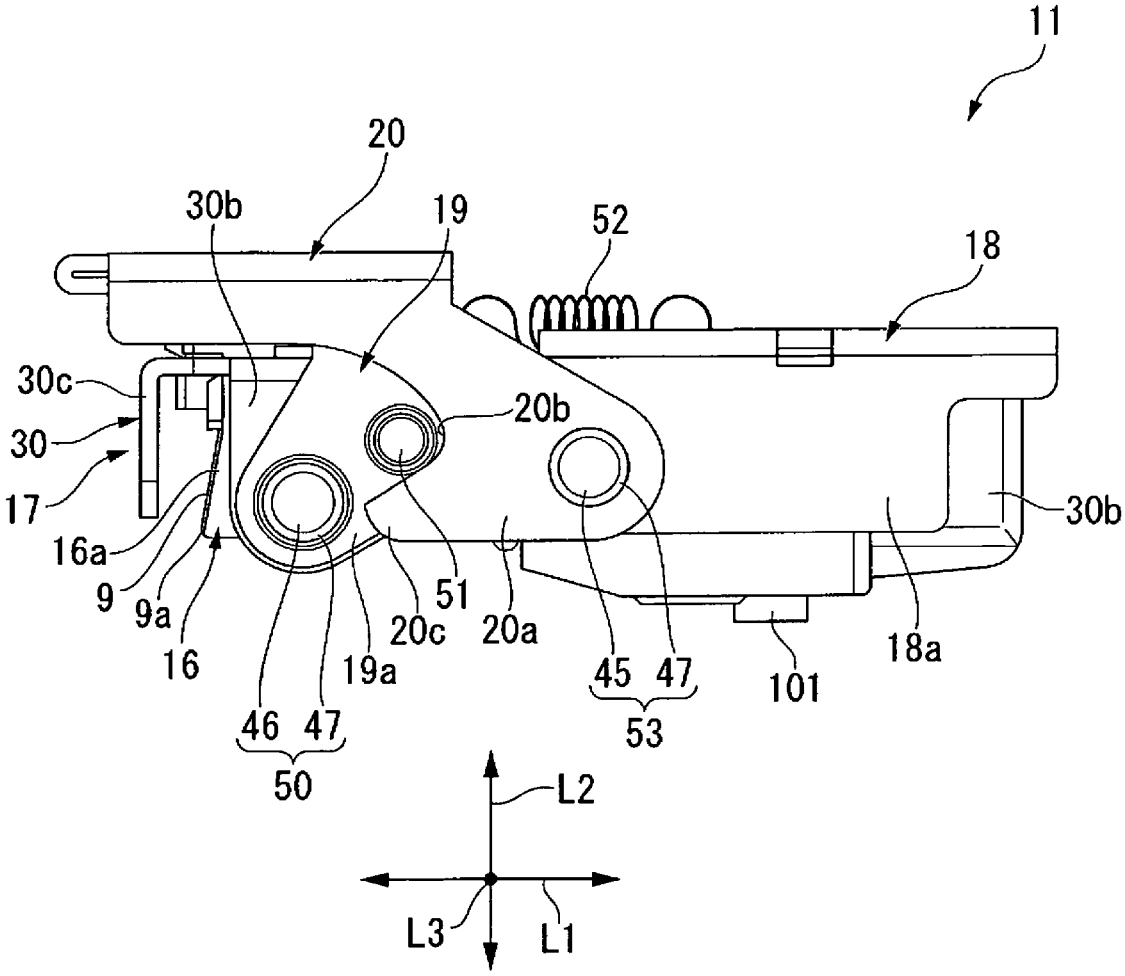
FIG. 7 is a side view of the detachable unit illustrated in FIG. 6.
Figure 8:
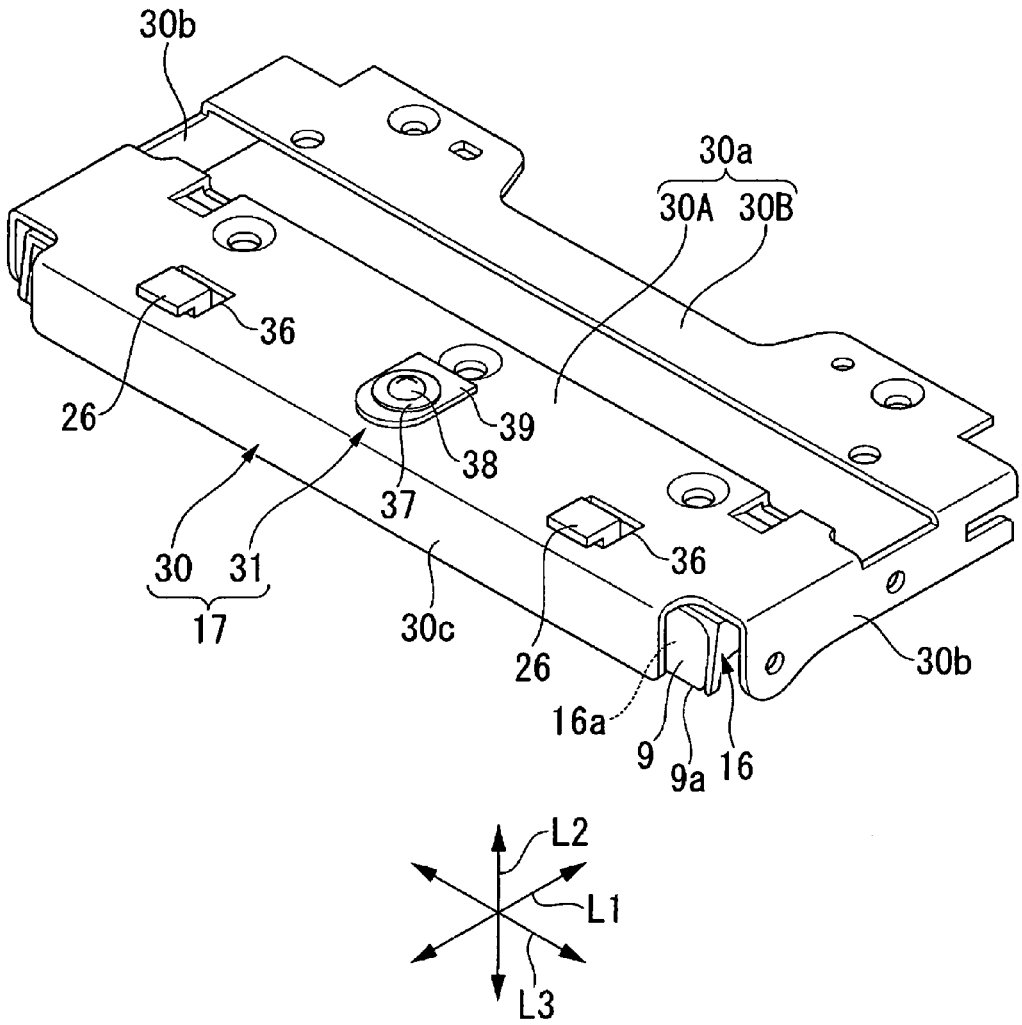
FIG. 8 is a perspective view illustrating a state in which a fixed blade holder cover, a latch cover, and a release cover are removed from the state illustrated in FIG. 6.
Figure 9:
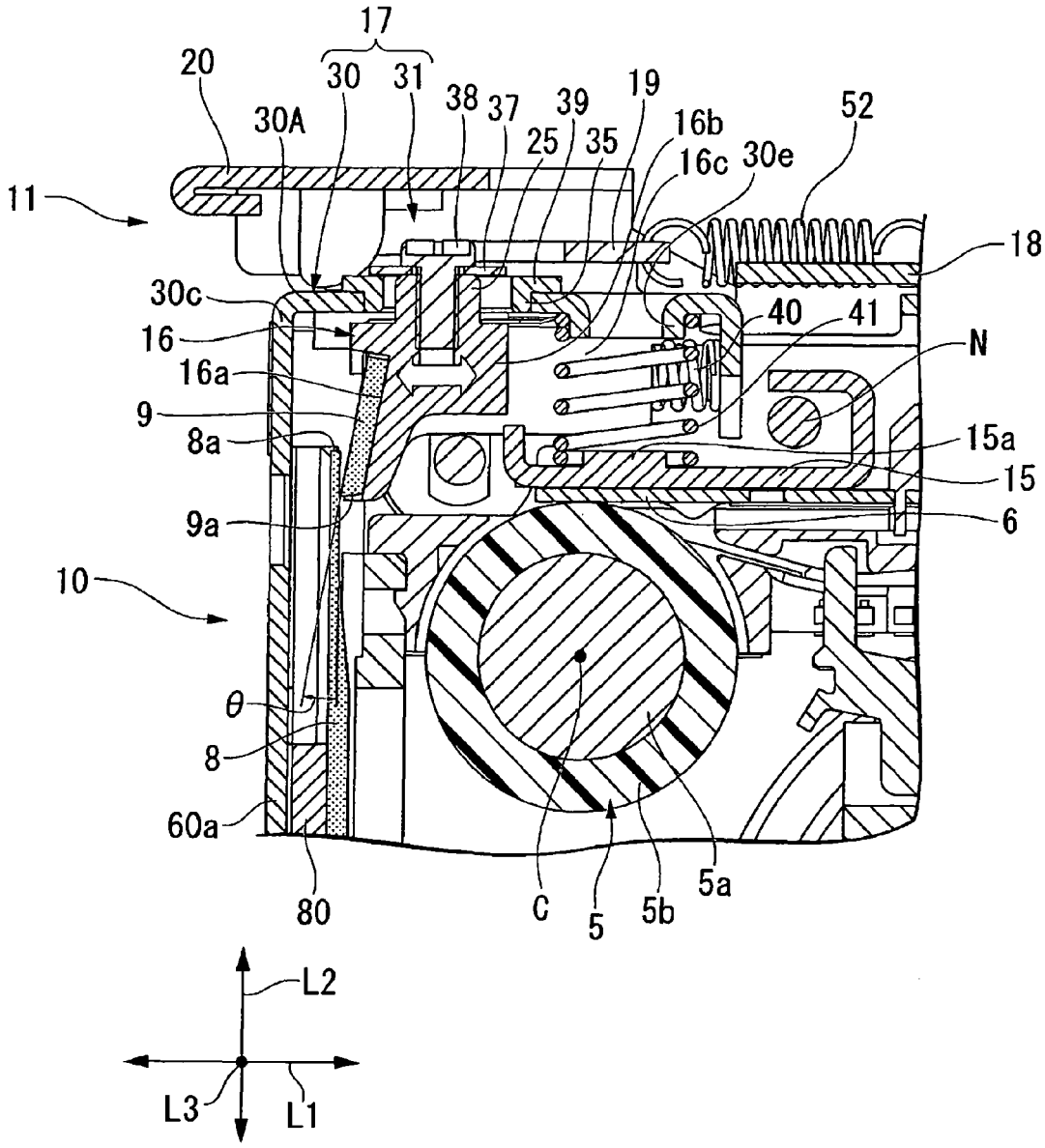
FIG. 9 is a view of an inner structure in which the main unit is combined with the detachable unit, with a movable blade riding on a fixed blade.

FIG. 6 is a perspective view of an outer appearance of the detachable unit 11. FIG. 7 is a side view of the detachable unit 11 illustrated in FIG. 6. FIG. 8 is a perspective view illustrating a state in which the fixed blade holder cover 18, the latch cover 19, and the release cover 20 are removed from the state illustrated in FIG. 6. FIG. 9 is an internal structural view illustrating the case where the main unit 10 and the detachable unit 11 are combined with each other, and illustrating a state in which the movable blade 8 rides on the fixed blade 9.

Figure 10:
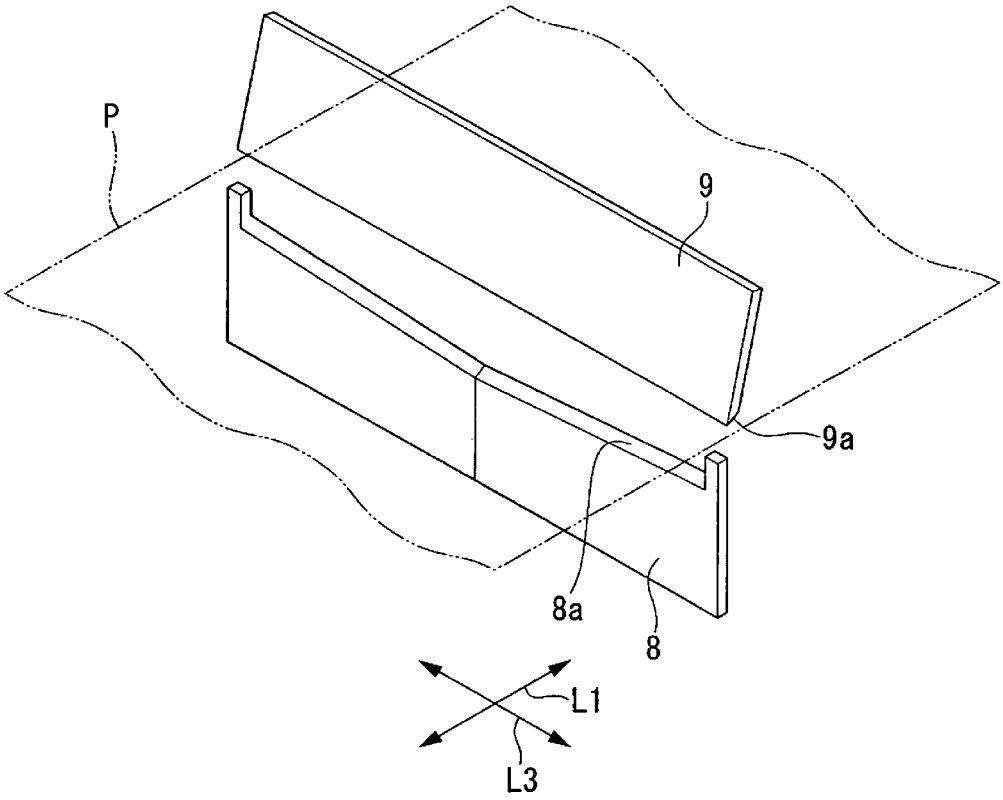
FIG. 10 is a view illustrating a positional relationship between the fixed blade and the movable blade.

As illustrated in FIG. 10, the fixed blade 9 is a blade in a plate shape extending in the right-and-left directions L3 that correspond to a width direction of the recording sheet P, with one side of both parallel sides being a cutting edge 9*a* and the other side being a root portion. The blade width direction of the fixed blade 9 refers to the longitudinal direction extending in the width direction (right-and-left directions L3) of the recording sheet P. FIG. 10 illustrates a positional relationship between the fixed blade 9 and the movable blade 8.

As illustrated in FIGS. 1, 2, and 9, the fixed blade 9 is held by the fixed blade holder 16 so that the cutting edge 9*a* is directed downward to be opposed to the sheet surface of the recording sheet P, when the detachable unit 11 is mounted on the main unit 10 with the open/close door 3 closed.

As illustrated in FIG. 9, the fixed blade holder 16 is a holder holding the fixed blade 9 in an inclined state (inclined forward from the root portion to the cutting edge 9*a*) with respect to the movable blade 8 so that the cutting edge 9*a* of the fixed blade 9 forms a predetermined cutting angle θ with respect to a cutting edge 8*a* of the movable blade 8 when the detachable unit 11 is mounted on the main unit 10 with the open/close door 3 closed.

As illustrated in FIGS. 9 and 11 to 13, specifically, the fixed blade holder 16 is integrally formed of a holder body 16*b* which extends in the blade width direction of the fixed blade 9 and in which a mounting surface 16*a* on which the fixed blade 9 is mounted and fixed is formed, and leg portions 16*c* that protrude backward from both right and left ends of the holder body 16*b*.

Figure 11:
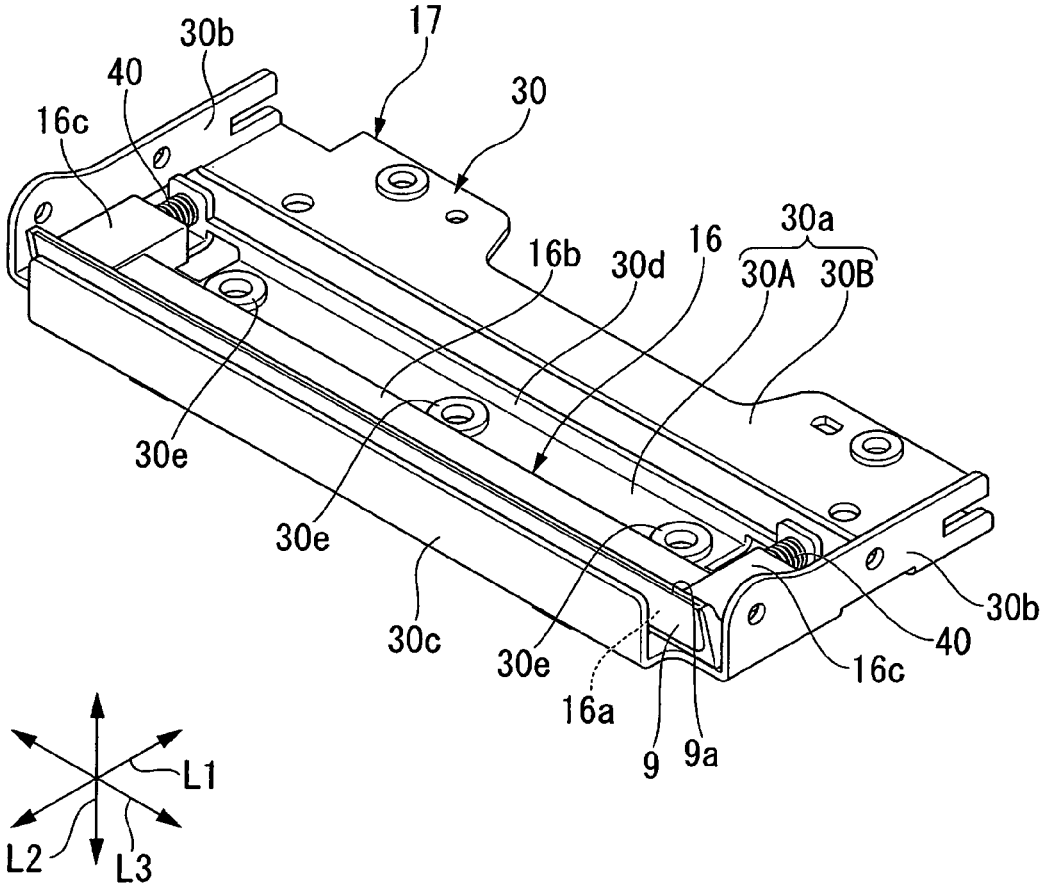
FIG. 11 is a perspective view illustrating a state in which a holder support frame illustrated in FIG. 8 is reversed.
Figure 12:
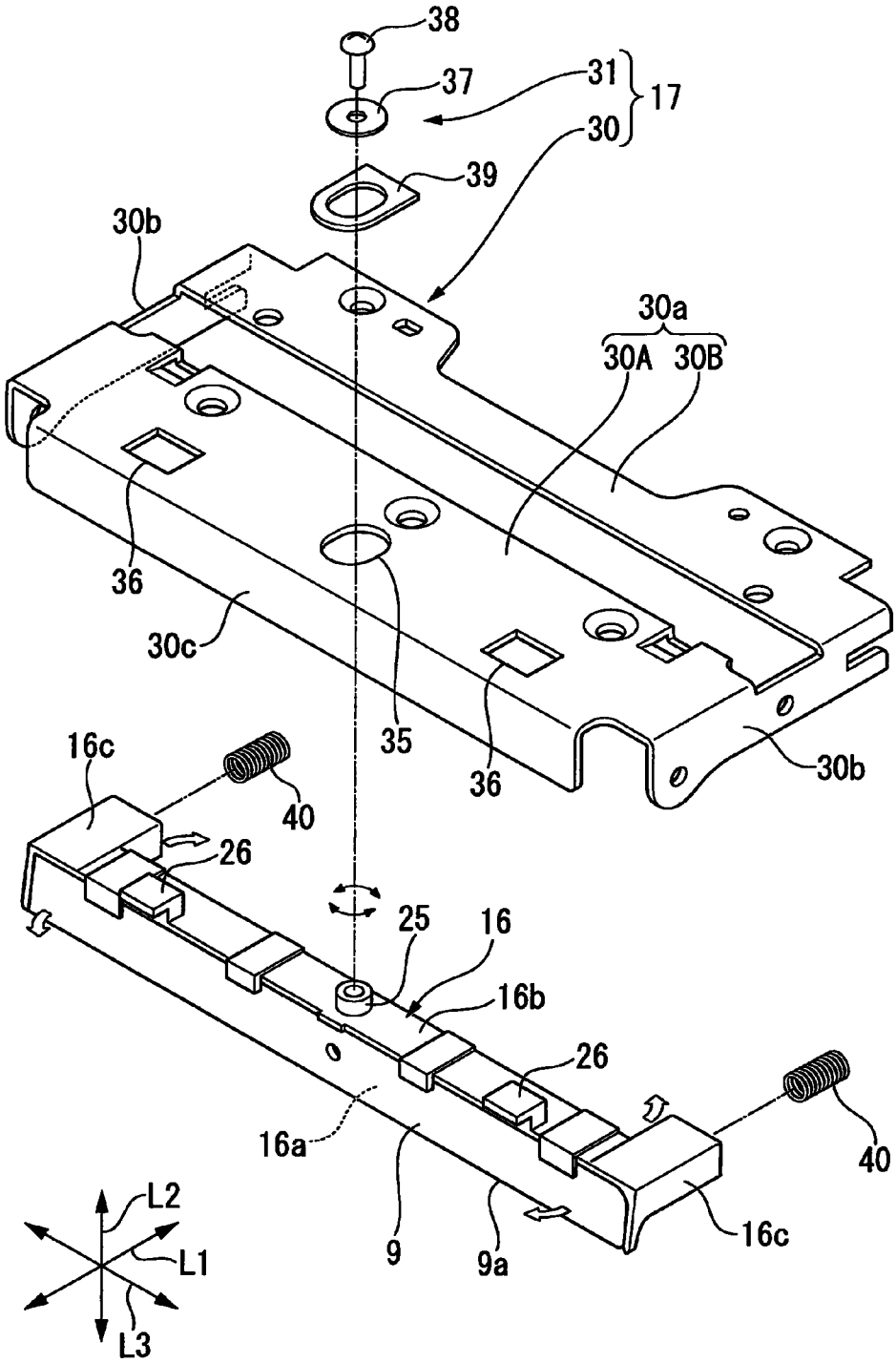
FIG. 12 is a view illustrating a state in which each component is disassembled from the state illustrated in FIG. 8.
Figure 13:
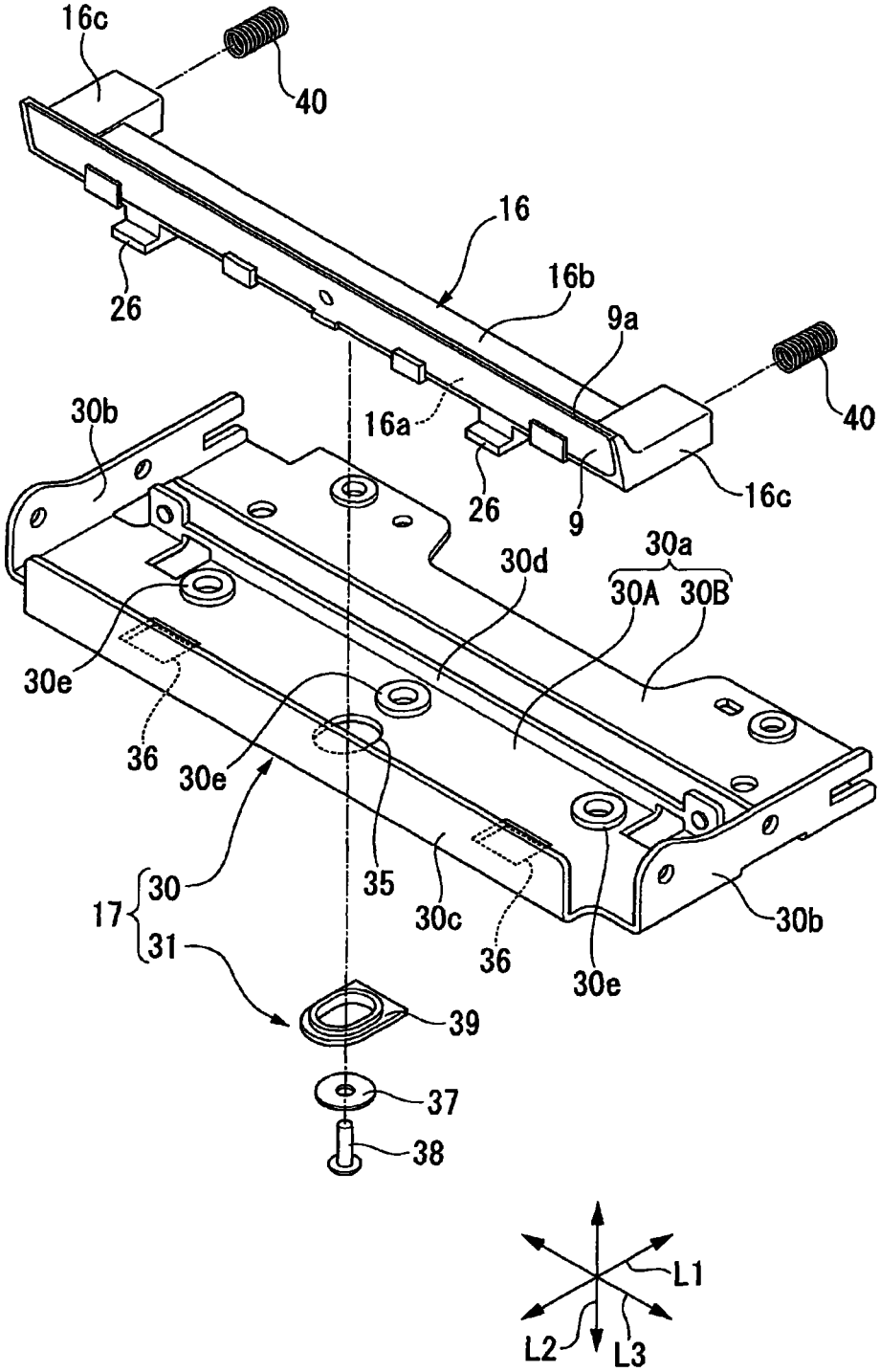
FIG. 13 is a view illustrating a state in which each component is disassembled from the state illustrated in FIG. 11.

FIG. 11 is a perspective view illustrating a state in which the holder support frame 17 illustrated in FIG. 8 is reversed. FIG. 12 illustrates a state in which each component is disassembled from the state illustrated in FIG. 8. FIG. 13 illustrates a state in which each component is disassembled from the state illustrated in FIG. 11.

The mounting surface 16*a* of the holder body 16*b* is formed as an inclined surface inclined gradually to the front side from an upper side to a lower side, and is designed so as to hold in an inclined state the fixed blade 9 that is mounted and fixed as described above. The upper surface of the holder body 16*b* is formed as a sliding surface that slidably comes into contact with a support frame 30 constituting the holder support frame 17 described later. At this time, on the upper surface of the holder body 16*b*, a boss 25 for connecting the support frame 30 to the holder body 16*b*, and two stopper hooks 26 regulating the movement amount of the holder body 16*b* are formed.

The boss 25 is formed at a position corresponding to the intermediate portion of the fixed blade 9 in the blade width direction on the upper surface of the holder body 16*b*. The two stopper hooks 26 are formed at a distance so as to interpose the boss 25 therebetween. The stopper hooks 26 are formed so that the hooks are directed to the front side.

The holder support frame 17 is orthogonal to the sliding direction (up-and-down directions L2) of the movable blade 8, and supports the fixed blade holder 16 movably in the orthogonal direction (fore-and-aft directions L1) in which the cutting edge 9*a* of the fixed blade 9 moves close to and away from the cutting edge 8*a* of the movable blade 8, and includes the support frame 30 and a coupling member 31.

The support frame 30 is a frame-shaped plate to be superimposed on the upper surface side of the holder body 16*b*, and includes a ceiling wall portion 30*a*, side panels 30*b* bent downward from both right and left sides of the ceiling wall portion 30*a*, and a front panel 30*c* bent downward from the front side of the ceiling wall portion 30*a*.

The ceiling wall portion 30*a* is a plate in a rectangular shape when viewed from above, which is formed longer than the fixed blade holder 16 in the right-and-left directions L3 and the fore-and-aft directions L1, and is partitioned into a front ceiling wall portion 30A and a back ceiling wall portion 30B by a cutout portion extending in the right-and-left directions L3. Then, the fixed blade holder 16 is superimposed on the front ceiling wall portion 30A while being surrounded by the side panels 30*b* and the front panel 30*c*.

Incidentally, in the front ceiling wall portion 30A, a guide opening 35 formed in a vertically oriented manner in the orthogonal direction (fore-and-aft directions L1) is formed at a position opposed to the boss 25. Further, stopper openings 36 are formed so as to be aligned in the right-and-left directions L3 with the guide opening 35 interposed therebetween. Then, the fixed blade holder 16 is superimposed on the front ceiling wall portion 30A so that the boss 25 is inserted in the guide opening 35 and the stopper hooks 26 are inserted in the stopper openings 36.

A fixing screw 38 is screwed via a washer 37 in the boss 25 inserted in the guide opening 35. This couples the support frame 30 to the fixed blade holder 16. In the guide opening 35, a collar 39 made of a resin for protecting an inner circumferential edge of the guide opening 35 is fitted. It should be noted that the collar 39 is not an indispensable element and may be omitted.

As described above, the fixed blade holder 16 is coupled to the support frame 30 with the fixing screw 38 inserted in the guide opening 35, and the fixing screw 38 is guided movably in the orthogonal direction (fore-and-aft directions L1) along the guide opening 35. Therefore, the fixed blade holder 16 can move in the orthogonal direction (fore-and-aft directions L1) along the guide opening 35.

The fixing screw 38, the washer 37, and the collar 39 are inserted in the guide opening 35, and function as the coupling member 31 coupling the support frame 30 to the fixed blade holder 16.

Further, a wall portion 30*d* rises from the front ceiling wall portion 30A along the cutout portion so as to be opposed to the front panel 30*c*. Coil springs (biasing members) 40 are provided between the wall portion 30*d* and the leg portions 16*c* of the fixed blade holder 16. Each of the coil springs 40 biases the fixed blade holder 16 toward the front panel 30*c* side. That is, each of the coil springs 40 plays a role of biasing the fixed blade holder 16 to the front side at all times so as to bring the cutting edge 9*a* of the fixed blade 9 into press-contact with the cutting edge 8*a* of the movable blade 8, when the movable blade 8 is slid.

At this time, as illustrated in FIG. 8, the stopper hooks 26 come into contact with the stopper openings 36 to regulate the excess forward movement of the fixed blade holder 16. Therefore, the fixed blade 9 is designed so as not to come into contact with the front panel 30*c* of the support frame 30.

Further, as illustrated in FIGS. 9 and 11, the front ceiling wall portion 30A is provided with three convex portions 30*e* at intervals along the wall portion 30*d*. The convex portions 30*e* are formed in, for example, a ring shape, and position coil springs 41 described later.

Further, the fixed blade holder 16 can move in the orthogonal direction (fore-and-aft directions L1) as described above. The fixed blade holder 16 is coupled to the support frame 30 at one place of the fixing screw 38, and hence, is swingable about the center axis of the fixing screw 38 in addition to the mere movement, as indicated by an arrow illustrated in FIG. 12. Therefore, the fixed blade 9 held by the fixed blade holder 16 swings with a high degree of freedom in the blade width direction with the fixed screw 38 being a pivot.

As illustrated in FIG. 9, the head support frame 15 supporting the thermal head 6 is provided below the holder support frame 17 thus configured. The head support frame 15 is attached to the holder support frame 17 so as to be capable of pivoting about a rotation pivot N.

The thermal head 6 is formed so as to extend in the width direction (right-and-left directions L3) of the recording sheet P, and a number of heat-generating elements (not shown) are arranged in the right-and-left directions L3 on the surface (lower surface) of the thermal head 6. Further, the coil springs 41 biasing the thermal head 6 to the platen roller 5 side are provided between the back surface (upper surface) of the head support frame 15 and the front ceiling wall portion 30A of the support frame 30. Thus, when the detachable unit 11 is combined with the main unit 10, the thermal head 6 is held in contact with the platen roller 5 with the recording sheet P sandwiched therebetween under a predetermined contacting pressure. Therefore, satisfactory printing can be performed with respect to the recording sheet P.

One end side of each coil spring 41 is externally provided on the convex portion 30*e* formed on the front ceiling wall portion 30A, and the other end side thereof is externally provided on a convex portion 15*a* formed on the head support frame 15. Thus, the coil springs 41 are provided between the head support frame 15 and the front ceiling wall portion 30A while being positioned precisely.

Further, as illustrated in FIGS. 6 and 7, the fixed blade holder cover 18 is attached to the holder support frame 17 so as to cover the back side, and the latch cover 19 is attached to the holder support frame 17 so as to cover the front side, as described above.

The fixed blade holder cover 18 is a cover in a C-shape, both the right and left sides of which are bent downward, and covers the back ceiling wall portion 30B of the support frame 30 from above, and is attached so that side wall portions 18*a* cover the side panels 30*b* of the support frame 30 from outside. Then, a shaft 45 is inserted so as to pass through the support frame 30 in the right-and-left directions L3 through the side wall portions 18*a* of the fixed blade holder cover 18 and the side panels 30*b* of the support frame 30.

Both the ends of the shaft 45 respectively protrude outward in the right-and-left directions L3 further from the side wall portions 18*a* of the fixed blade holder cover 18.

The latch cover 19 is a cover in a C-shape, both the right and left sides of which are bent downward in the same way as in the fixed blade holder cover 18, and covers the front ceiling wall portion 30A of the support frame 30 from above and is provided so that side wall portions 19*a* cover the side panels 30*b* of the support frame 30 from outside. The latch cover 19 is coupled to the support frame 30 via a shaft 46, and can rotate about the shaft 46 in the fore-and-aft directions L1.

The shaft 46 is inserted so as to pass through the support frame 30 in the right-and-left directions L3 through the side panels 30*b* of the support frame 30 and the side wall portions 19*a* of the latch cover 19, and both ends thereof protrude outward in the right-and-left directions L3 further from the side wall portions 19*a* of the latch cover 19. Cylindrical bushes 47 are fitted at both ends of the shaft 46.

Each end of the shaft 46 and each of the bushes 47 function as an engagement pin 50 protruding along an axial line that is non-coaxial and parallel with respect to a platen shaft C of the platen roller 5 provided on the main unit 10 side. That is, the latch cover 19 can rotate freely about the axial line of the engagement pin 50 in the fore-and-aft directions L1.

Further, a lock pin 51 protruding in the right-and-left directions L3 is formed integrally on each of the side wall portions 19*a* of the latch cover 19. The lock pin 51 is formed so as to be parallel to the engagement pin 50 at a position separated by a predetermined distance from the axial line of the engagement pin 50, and rotates and moves so as to draw an arcuate path about the axial line of the engagement pin 50 along with the rotation of the latch cover 19. That is, the lock pin 51 can make relative movement in a virtual plane (virtual plane S illustrated in FIG. 6, orthogonal to the right-and-left directions L3) orthogonal to the platen shaft C with respect to the engagement pin 50 along with the rotation of the latch cover 19.

Further, coil springs (biasing members) 52 are attached between the latch cover 19 and the fixed blade holder cover 18, and pull the latch cover 19 to the fixed blade holder cover 18 side. That is, the coil springs 52 bias the latch cover 19 so that the lock pin 51 rotates and moves toward the back side.

The latch cover 19 thus configured is further covered with the release cover 20.

The release cover 20 is a C-shaped cover, both right and left sides of which are bent downward, and covers the latch cover 19 and the front panel 30*c* of the support frame 30 from above, and is provided so that side wall portions 20*a* cover the side wall portions 18*a* of the fixed blade holder cover 18 from outside. At this time, the release cover 20 is coupled to the fixed blade holder cover 18 via the shaft 45 described above, and can rotate about the shaft 45.

The cylindrical bushes 47 are fitted at both ends of the shaft 45 protruding outward in the right-and-left directions L3 from the side wall portions 20*a* of the release cover 20. Then, each end of the shaft 45 and each of the bushes 47 function as an auxiliary pin 53 protruding in a direction parallel to the engagement pin 50. Thus, the release cover 20 can rotate about the axial line of the auxiliary pin 53.

Incidentally, the side wall portion 20*a* of the release cover 20 is provided with a curved recess 20*b* so that a part of a front edge side is curved smoothly toward the back and a hook portion 20*c* protrudes forward due to the curved recess 20*b*. Then, the latch cover 19 and the release cover 20 are combined so that the lock pin 51 is fitted in the curved recess 20*b*.

In particular, the latch cover 19 is pulled to the fixed blade holder cover 18 side by the coil springs 52 at all times. Therefore, the lock pin 51 is fitted in the curved recess 20*b* reliably, and the lock pin 51 presses the hook portion 20*c* downward. Thus, the release cover 20 receives a force from the lock pin 51, and is biased so as to rotate to the front side covering the front panel 30*c* of the support frame 30 at all times.

The detachable unit 11 thus configured is attached to the inner surface of the open/close door 3 via the release cover 20. Therefore, when the open/close cover 3 is opened while the detachable unit 11 is combined with the main unit 10, the release cover 20 rotates to the back side separated from the front panel 30*c* of the support frame 30 about the axial line of the auxiliary pin 53 accordingly.

Then, the hook portion 20*c* formed in the side wall portion 20*a* of the release cover 20 pushes up the lock pin 51 to rotate and move the lock pin 51 to a front side that is an opposite direction to the biasing direction by the coil spring 52.

(Main Unit)

Next, the main unit 10 is described.

Figure 14:
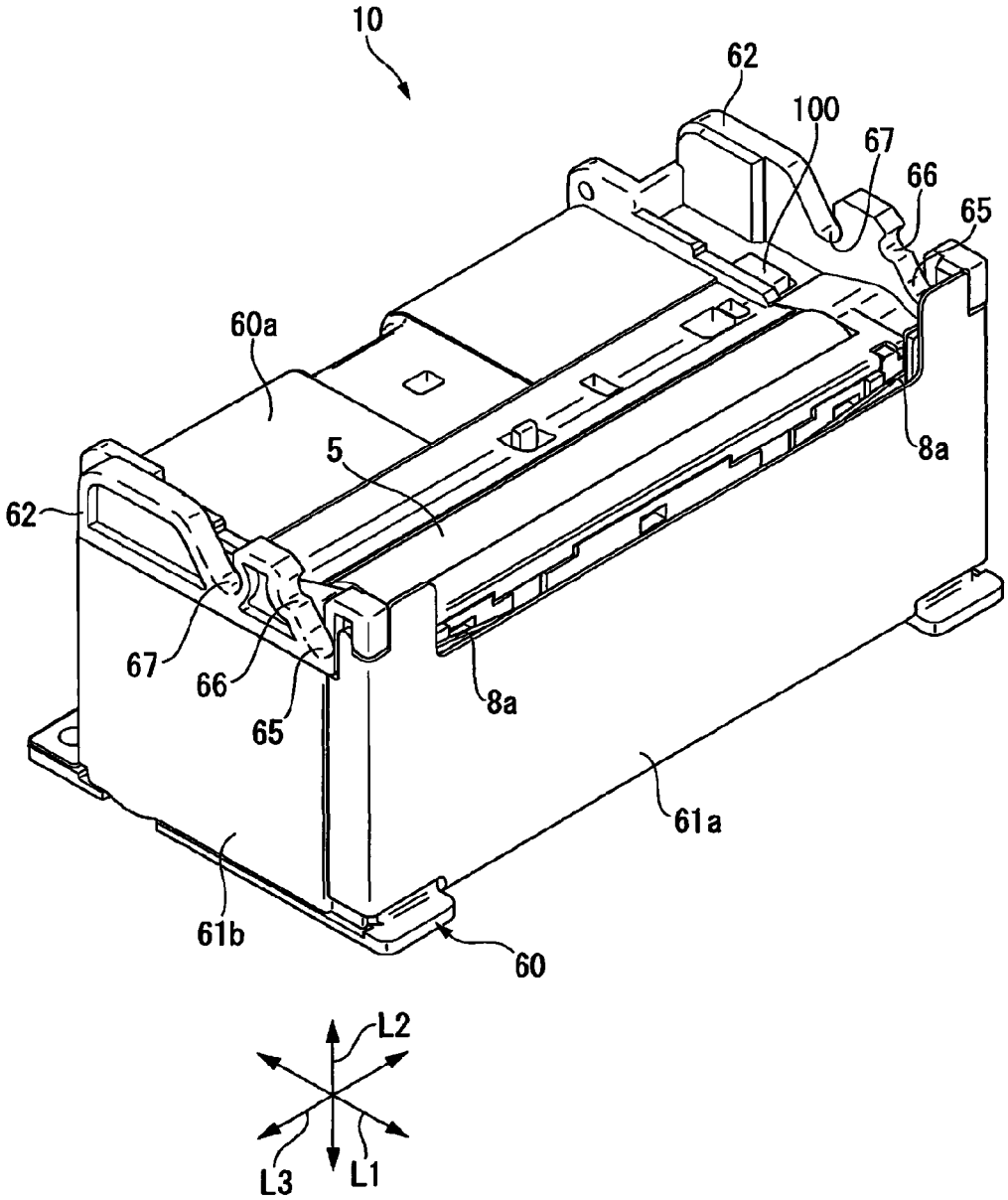
FIG. 14 is a perspective view of the main unit.

As illustrated in FIGS. 3 to 5 and 14, the main unit 10 mainly includes the movable blade 8, the platen roller 5, and a main frame 60 supporting the movable blade 8 and the platen roller 5. FIG. 14 is a perspective view of the main unit 10.

The main frame 60 is formed of metal, a resin, or the like in a box shape, and an upper surface 60*a* functions as a passage plane for the recording sheet P. The recording sheet P is fed while a surface opposite to a printed surface is faced to the upper surface 60*a* that is the passage plane.

Further, a front cover 61*a* and side covers 61*b* are detachably attached to a front wall portion 60*b* and side wall portions 60*c* of the main frame 60. Each side wall portion 60*c* is formed at a position dented inside of the main frame 60, and an accommodating space E in which each component can be accommodated is ensured within the side wall portions 60*c* and the side covers 61*b*.

A pair of opposed walls 62, which protrude above the upper surface 60*a* and are opposed to each other in the right-and-left directions L3 with the upper surface 60*a* interposed therebetween, are provided continuously with upper portions of the side wall portions 60*c*.

The pair of opposed walls 62 are each provided with a plurality of recesses for combining the detachable unit 11 with the main unit 10 separably. That is, a first recess 65, a second recess 66, and a third recess 67 are respectively formed from the front side to the back side in this order.

The main unit 10 is sized so that the side wall portions 20*a* of the release cover 20 are positioned inside the opposed walls 62 when the detachable unit 11 is combined with the main unit 10.

The first recess 65 allows the engagement pin 50 to be fitted therein detachably to arrange the thermal head 6 and the platen roller 5 so that the thermal head 6 and the platen roller 5 are opposed to each other in a contact state, and is formed so as to be opened diagonally from the upper edge to the front side of the opposed wall 62.

The second recess 66 allows the lock pin 51 to be fitted therein detachably after the engagement pin 50 is fitted in the first recess 65, and is formed so as to be opened diagonally from the midway of the opening of the first recess 65 to the back side.

In particular, the latch cover 19 receives a force for rotating the latch cover 19 to the back side by the coil springs 52. Therefore, the lock pin 51 is fitted in the second recess 66 naturally. When being fitted in the second recess 66, the lock pin 51 is simultaneously fitted in the curved recess 20*b* formed in the side wall portion 19*a* of the latch cover 19 and presses the hook portion 20*c* of the latch cover 19 downward. Thus, after the detachable unit 11 is mounted, the release cover 20 is biased so as to rotate to the front side covering the front panel 30*c* of the support frame 30.

Figure 15:
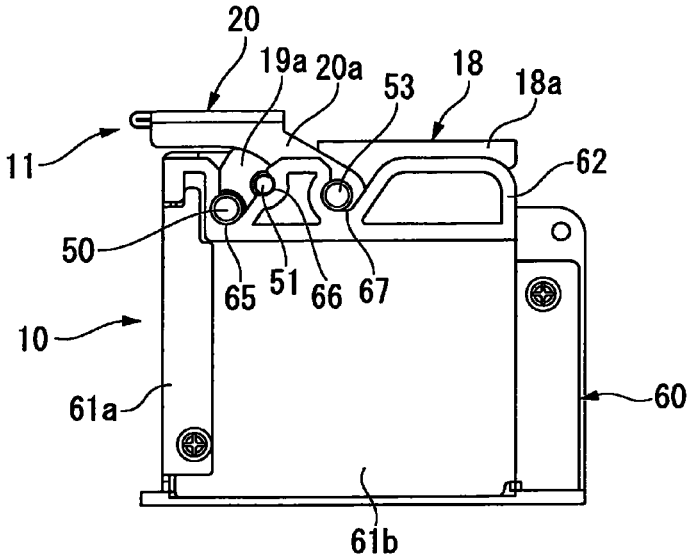
FIG. 15 is a view illustrating a state in which the main unit is combined with the detachable unit when seen from a side.

Further, as illustrated in FIGS. 3 and 15, when the engagement pin 50 and the lock pin 51 are fitted in the first recess 65 and the second recess 66, respectively, a part of an inner circumferential edge of the second recess 66 prevents the lock pin 51 from moving in the opening direction of the first recess 65. Thus, as long as the lock pin 51 is not detached from the second recess 66, the engagement pin 50 cannot be detached from the first recess 65.

FIG. 15 is a view illustrating a state in which the main unit 10 and the detachable unit 11 are combined when viewed from a side.

Figure 16:
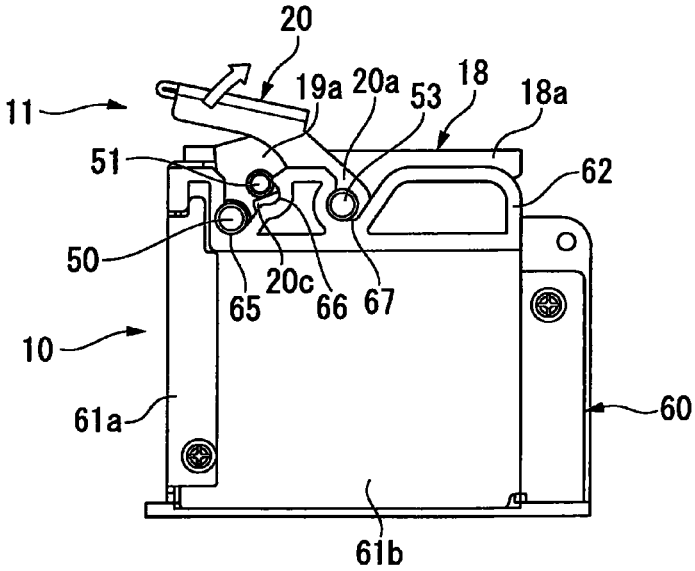
FIG. 16 is a view illustrating a state in which the release cover is rotated backward from the state illustrated in FIG. 15, and a lock pin is pushed up by a hook portion.
Figure 17:
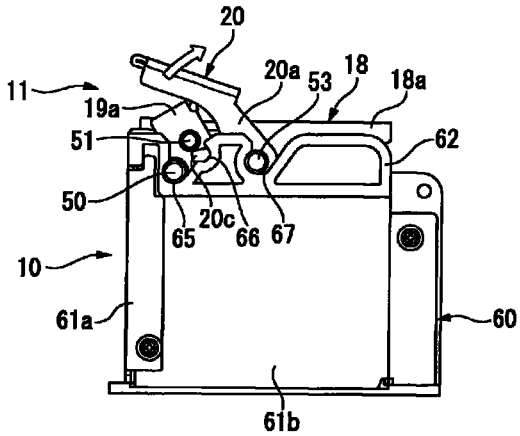
FIG. 17 is a view illustrating a state in which the lock pin is pushed up further from the state illustrated in FIG. 16.

On the other hand, when the release cover 20 is rotated to the back side about the axial line of the auxiliary pin 53, the lock pin 51 is pushed up by the hook portion 20*c* and can be rotated in a direction opposite to the biasing direction by the coil springs 52, as illustrated in FIGS. 16 and 17. This enables the lock pin 51 to be detached from the second recess 66. Thus, when the lock pin 51 is detached, the engagement pin 50 can be detached from the first recess 65.

FIG. 16 is a view illustrating a state in which the release cover 20 is rotated to the back side from the state illustrated in FIG. 15, and the lock pin 51 is pushed up by the hook portion 20*c*. FIG. 17 is a view illustrating a state in which the lock pin 51 is further pushed up from the state illustrated in FIG. 16.

More specifically, the engagement pin 50 according to this embodiment cannot be detached from the first recess 65 when the lock pin 51 is fitted in the second recess 66, and can be detached from the first recess 65 after the lock pin 51 is detached from the second recess 66. Thus, only when the engagement pin 50 is detached from the first recess 65 after the lock pin 51 is detached from the second recess 66 first, the detachable unit 11 can be separated from the main unit 10.

Further, the third recess 67 allows the auxiliary pin 53 to be fitted therein detachably at a timing when the engagement pin 50 is fitted in the first recess 65, and is formed so as to be opened in the same direction as the opening direction of the first recess 65.

Thus, even if an external force of rotating the lock pin 51 about the axial line of the engagement pin 50 to detach the lock pin 51 from the second recess 66 acts on the entire detachable unit 11 when the detachable unit 11 is mounted on the main unit 10, the auxiliary pin 53 comes into contact with a part of the inner circumferential edge of the third recess 67 to regulate the movement of the detachable unit 11.

Accordingly, the lock pin 51 is prevented from being detached from the second recess 66 unintentionally, and the reliability during mounting of the detachable unit 11 can be enhanced, and the looseness and the like of the detachable unit 11 can be suppressed easily.

As illustrated in FIG. 9, the platen roller 5 has a configuration in which a roller 5*b* made of an elastic material such as rubber is provided externally on an axial body 5*a* such as a shaft extending in the width direction of the recording sheet P. As illustrated in FIGS. 3 and 4, both ends of the axial body 5*a* are axially supported by the side wall portions 60*c* of the main frame 60 via bearing members 70. At the end on one side of the axial body 5*a*, a driven gear to be meshed with a gear train mechanism for a platen (not shown) is fixed. Then, due to the drive of a platen motor (not shown) provided in the main frame 60, a rotational force is transmitted to the driven gear via the gear train mechanism for a platen, which rotates the platen roller 5.

As illustrated in FIGS. 3, 4, and 9, the platen roller 5 is placed so that a part thereof is exposed from the upper surface 60*a* of the main frame 60. The platen roller 5 plays a role of feeding the recording sheet P to the front side that is a downstream side while sandwiching the recording sheet P together with the thermal head 6 and sending out the recording sheet P between the fixed blade 9 and the movable blade 8, when the detachable unit 11 is mounted on the main unit 10.

The movable blade 8 has a function as a cutter for cutting the recording sheet P in cooperation with the fixed blade 9, and is placed at a position opposed to the fixed blade 9 when the detachable unit 11 is mounted on the main unit 10, as illustrated in FIGS. 1 and 2. As illustrated in FIG. 10, the movable blade 8 is a plate-shaped blade in a substantially V-shape when viewed from above, which is formed so that the length from the root to the cutting edge 8*a* becomes shorter gradually from both ends to the center. When the movable blade 8 is slid toward the fixed blade 9, the movable blade 8 rides on the fixed blade 9, as illustrated in FIGS. 9 and 18, and cuts the recording sheet P while sandwiching it between the movable blade 8 and the fixed blade 9.

Figure 18:
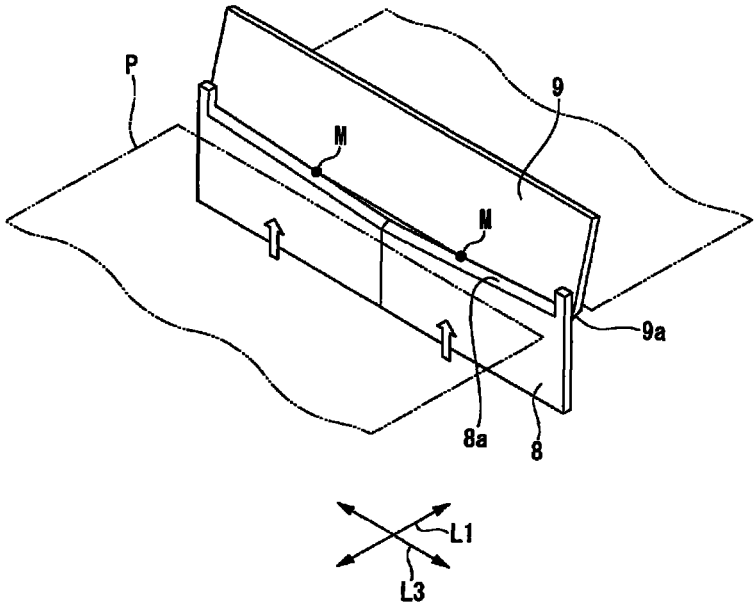
FIG. 18 is a view illustrating a state in which the movable blade is slid from the state illustrated in FIG. 10.

FIG. 18 illustrates a state in which the movable blade 8 is slid from the state illustrated in FIG. 10.

Because the movable blade 8 is formed in a substantially V-shape when viewed from above, the movable blade 8 comes into contact with the fixed blade 9 at two right and left points (points M illustrated in FIG. 18). Further, the movable blade 8 according to this embodiment is curved smoothly in the width direction so that both ends are warped from the center portion so as to come into contact with the fixed blade 9 reliably at the two right and left points. Thus, the recording sheet P can be cut from both right and left sides to the center along with the slide of the movable blade 8.

As illustrated in FIGS. 5 and 9, the movable blade 8 thus formed is placed inside of the front wall portion 60*b* of the main frame 60 with the cutting edge 8*a* directed upward, and fixed to a movable blade holder 80. The movable blade holder 80 is a plate-shaped member made of a resin or the like and is guided movably in the up-and-down directions L2 by guide means (not shown). This enables the movable blade 8 to be slid in the up-and-down directions L2 substantially orthogonal to the sheet surface of the recording sheet P.

Figure 19:
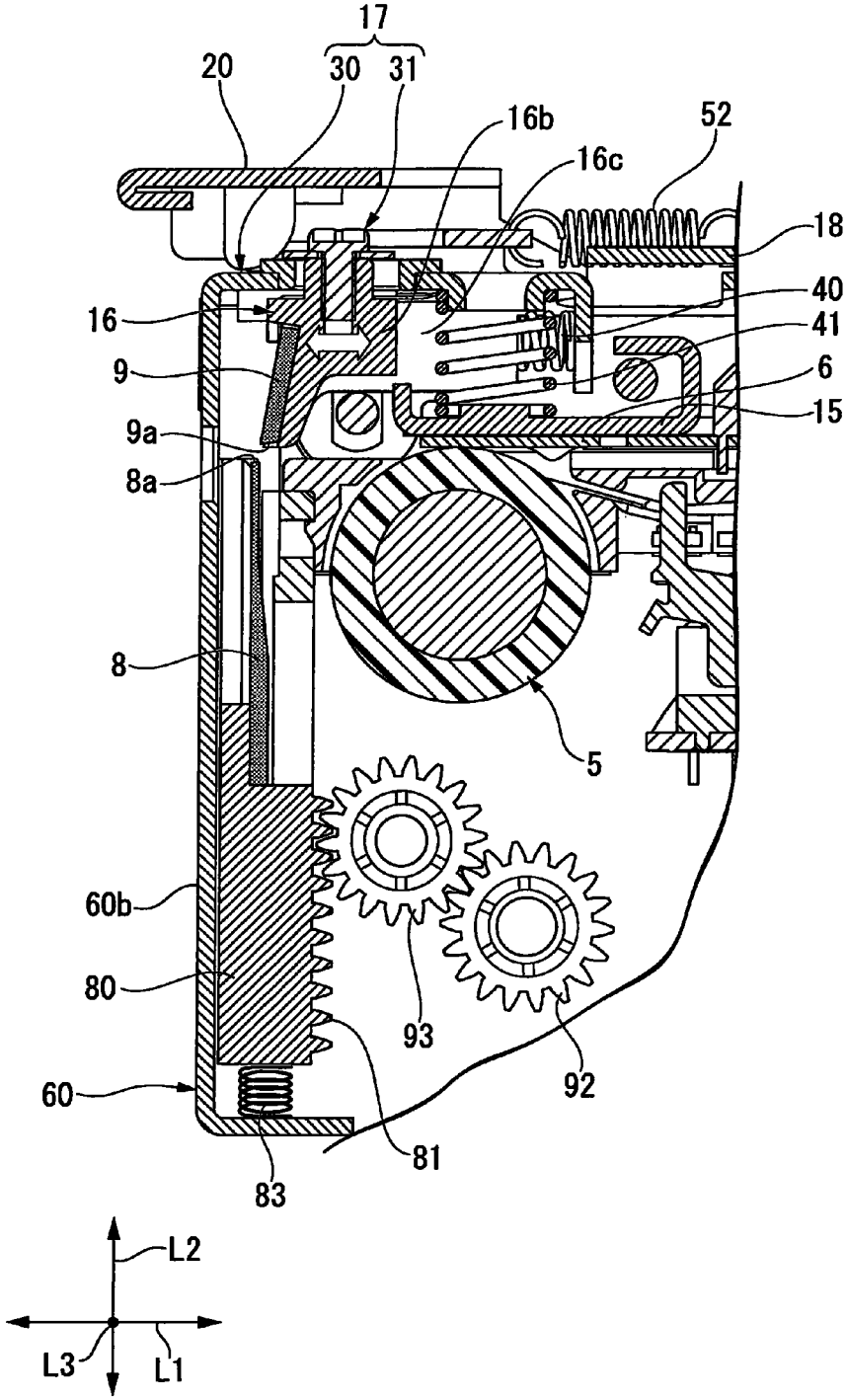
FIG. 19 is a view of a part of an inner structure in a main frame.

As illustrated in FIG. 19, a rack (reciprocating mechanism) 81 is integrally formed in a lower end portion of the movable blade holder 80. FIG. 19 illustrates a part of an inner structure of the main frame 60.

As illustrated in FIGS. 3 and 4, the rack 81 plays a role of reciprocating the movable blade holder 80 linearly in the up-and-down directions L2 along with the rotation of a drive gear 82 coupled to a movable blade motor (see FIG. 20) 95. Further, as illustrated in FIG. 19, a coil spring (biasing member) 83 is attached between the movable blade holder 80 with the rack 81 attached thereto and the bottom wall portion of the main frame 60, and the coil spring 83 pulls the movable blade holder 80 in a downward direction of separating the movable blade 8 from the fixed blade 9. Thus, a downward force is applied to the movable blade holder 80 at all times.

As illustrated in FIGS. 3, 4, and 19, a gear train mechanism for a movable blade (gear train mechanism) 90 including a first gear 91, a second gear 92, and a third gear 93 is provided between the rack 81 and the drive gear 82.

The gear train mechanism for a movable blade 90 couples the drive gear 82 to the rack 81 to transmit a rotational force of the drive gear 82 to the rack 81 when the detachable unit 11 is combined with the main unit 10 as illustrated in FIG. 3, and disconnects the drive gear 82 from the rack 81 when the detachable unit 11 is separated from the main unit 10 as illustrated in FIG. 4.

Hereinafter, the configuration is described in detail.

The movable blade motor (see FIG. 20) 95 is placed in the main frame 60, and a drive shaft of the movable blade motor protrudes to the side wall portion 60*c*. Then, the drive gear 82 is fixed to the drive shaft. The third gear 93 is axially supported on the side wall portion 60*c* while being meshed with the rack 81. Further, the second gear 92 is axially supported on the side wall portion 60*c* similarly while being meshed with the third gear 93.

Figure 20:
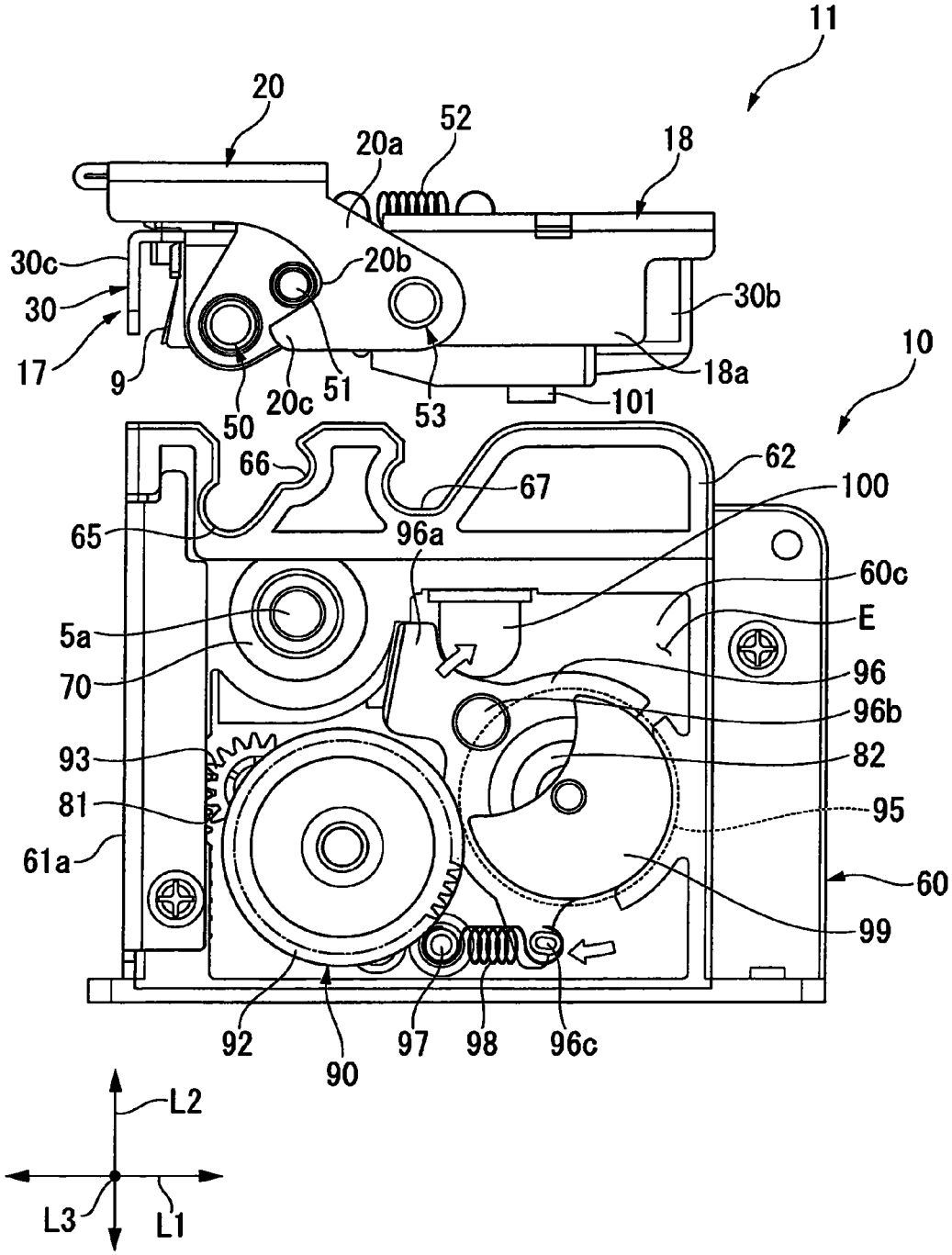
FIG. 20 is a side view of the main unit illustrated in FIG. 4, with a first gear removed.
Figure 21:
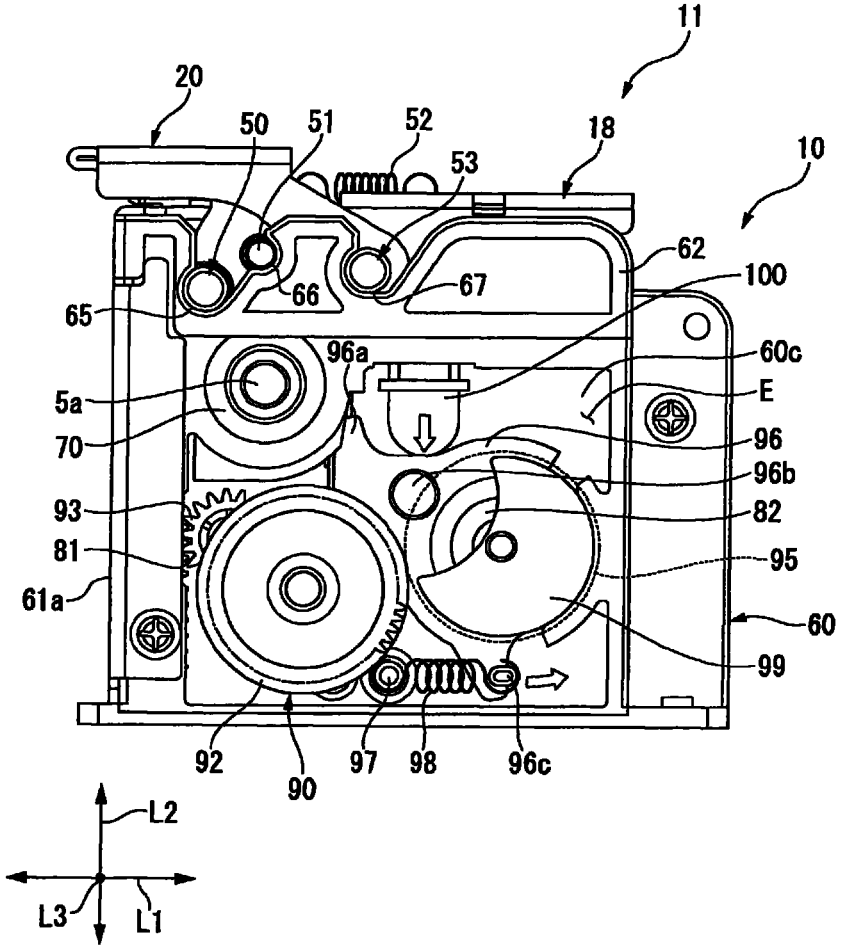
FIG. 21 is a side view of the main unit illustrated in FIG. 3, with the first gear removed.

As illustrated in FIGS. 20 and 21, a swinging plate 96 that swings forward/backward with respect to the drive shaft is placed between the drive gear 82 and the side wall portion 60*c*.

FIG. 20 is a side view of the main unit 10 illustrated in FIG. 4, which illustrates a state in which the first gear 91 is removed. FIG. 21 is a side view of the main unit 10 illustrated in FIG. 3, which illustrates a state in which the first gear 91 is removed.

The swinging plate 96 is formed in a substantially semicircular shape when viewed from above, and a part on an upper portion side thereof forms a hook-shaped locking piece 96*a* protruding outward. Further, at the swinging plate 96, a shaft core 96*b* axially supporting the first gear 91 in the vicinity of the root of the locking piece 96*a* rises so as to be adjacent to the drive gear 82, and a fixing pin 96*c* for fixing one end side of a coil spring (biasing member) 98 described later rises on a lower portion side.

The first gear 91 is attached to the shaft core 96*b* of the swinging plate 96 while being meshed with the drive gear 82. Therefore, the first gear 91 rotates about the drive shaft along with the swing of the swinging plate 96, and moves close to the second gear 92 to be meshed therewith as illustrated in FIGS. 3 and 21 or moves away from the second gear 92 to cancel the mesh as illustrated in FIGS. 4 and 20.

Herein, a fixing pin 97 rises on the side wall portion 60*c* in the vicinity of the second gear 92, and the coil spring 98 is attached between the fixing pin 97 and the fixing pin 96*c* of the swinging plate 96. The coil spring 98 biases the swinging plate 96 so that the swinging plate 96 is rotated to the back side at which the first gear 91 is moved away from the second gear 92 as illustrated in FIG. 20. Thus, as long as an external force is not given to the swinging plate 96, the first gear 91 and the second gear 92 are disconnected from each other.

The swinging plate 96 is provided with a protective cover 99 in a crescent shape when viewed from above, which protects the drive gear 82.

A push button 100 is in contact with the locking piece 96*a* of the swinging plate 96. The push button 100 is attached to the upper surface 60*a* of the main frame 60 so as to move up/down, and as illustrated in FIG. 14, an upper portion is exposed from the upper surface 60*a*. Further, as illustrated in FIG. 20, a lower portion of the push button 100 is formed in a smooth arcuate shape and rides on the locking piece 96*a*. Thus, the push button 100 is pushed upward by the locking piece 96*a* so that the upper portion thereof sticks out of the upper surface 60*a*.

With such a configuration, in the case where the detachable unit 11 is separated from the main unit 10, as illustrated in FIGS. 4 and 20, the swinging plate 96 is rotated to the back side due to the force of the coil spring 98 to disconnect the first gear 91 from the second gear 92. Consequently, the rack 81, the third gear 93, and the second gear 92 are not engaged with the drive gear 82, i.e., are in a free state. Thus, as illustrated in FIG. 19, the movable blade holder 80 pulled downward by the coil spring 83 cannot be moved upward, and the movable blade 8 can be placed in a standby position of being moved away from the fixed blade 9.

On the other hand, in the case where the detachable unit 11 is mounted on the main unit 10, as illustrated in FIGS. 3 and 21, the push button 100 is pressed by a push protrusion 101 (see FIG. 20) provided at the detachable unit 11, to thereby move downward. This enables a downward force to be applied to the locking piece 96*a* and enables the swinging plate 96 to rotate to the front side due to the force against the coil spring 98, which allows the first gear 91 to be meshed with the second gear 92. Consequently, the drive gear 82 is coupled to the rack 81, and the rotational force of the drive gear 82 can be transmitted to the rack 81.

Next, the operation of the thermal printer 1 configured as described above is described.

First, as illustrated in FIG. 2, the paper roll R is inserted in the casing 2 through the insertion port 2*a* while the open/close door 3 is opened. At this time, the recording sheet P is previously pulled outside the casing 2 by some length. Then, while the pulled-out recording sheet P is pulled outside the casing 2, the open/close door 3 is closed and locked with a lock mechanism. Simultaneously with this, the detachable unit 11 is mounted on the main unit 10, and thus, both the units 10, 11 are combined with each other.

Consequently, as illustrated in FIG. 1, the recording sheet P is sandwiched between the platen roller 5 and the thermal head 6, and is pulled outside the casing 2 from the discharge port 2*c*.

Incidentally, as illustrated in FIGS. 4 and 21, while the open/close door 3 is opened, the swinging plate 96 is pulled by the coil spring 98, and hence, the first gear 91 and the second gear 92 are disconnected from each other. Therefore, the rack 81, the third gear 93, and the second gear 92 are not engaged with the drive gear 82, i.e., are in a free state. Thus, the movable blade holder 80 is pulled downward by the coil spring 83 as illustrated in FIG. 19. This places the movable blade 8 at a standby position of being moved away from the fixed blade 9. Further, as illustrated in FIG. 14, the push button 100 is in a state of sticking out of the upper surface 60*a* of the main frame 60.

In particular, because the rack 81 and the drive gear 82 are disconnected from each other, even if the movable blade motor 95 is driven by mistake under a state before closing the open/close door 3, the rack 81 does not move linearly to slide the movable blade 8. Thus, due to an interlock structure regulating the slide of the movable blade 8, the movable blade 8 is allowed to be placed at a standby position continuously, which can ensure high safety.

Subsequently, when the open/close door 3 starts being closed, the detachable unit 11 gradually approaches the main unit 10 while drawing an arcuate path with respect to the hinge portion 7, and finally moves close to the main unit 10 in the sliding direction (up-and-down directions L2) of the movable blade 8. Then, the engagement pin 50 and the auxiliary pin 53 of the detachable unit 11 first start entering the first recess 65 and the third recess 67, and the lock pin 51 slips off while being in contact with an inclined portion that is an inlet of the first recess 65.

At this time, the reaction force against a force pressing down the open/close door 3 functions to push up the lock pin 51 via the inclined portion. Then, the reaction force is transmitted to the latch cover 19 via the lock pin 51, and hence, the latch cover 19 rotates to the front side about the axial line of the engagement pin 50. That is, the latch cover 19 moves downward along with the closing operation of the open/close door 3 while rotating to the front side about the axial line of the engagement pin 50.

Thus, the engagement pin 50 and the auxiliary pin 53 gradually enter an innermost part of the first recess 65 and an innermost part of the third recess 67 at the same timing, and, as illustrated in FIGS. 3 and 15, are fitted in the first recess 65 and the third recess 67 completely at a time when the open/close door 3 is closed completely. Further, at this time, the lock pin 51 reaches the inlet of the second recess 66. In this case, the latch cover 19 is pulled to the fixed blade holder cover 18 side by the coil spring 52, and hence, the latch cover 19 is to be rotated to the back side. Therefore, the lock pin 51 having reached the inlet of the second recess 66 can be immediately pulled in and fitted in the second recess 66.

Consequently, simultaneously with the closing of the open/close door 3, the detachable unit 11 can be combined with the main unit 10 while the detachable unit 11 is mounted on the main unit 10. Further, the engagement pin 50 can be set in the first recess 65 so as not to be detached therefrom.

Further, as illustrated in FIGS. 1 and 19, at this time, the thermal head 6 and the platen roller 5 can be arranged so as to be opposed to each other with the recording sheet P sandwiched therebetween. In this case, because the head support frame 15 is biased to the platen roller 5 side by the coil springs 41, the thermal head 6 can be brought into contact with the platen roller 5 under a predetermined press-contact force. Further, the cutting edge 9*a* of the fixed blade 9 and the cutting edge 8*a* of the movable blade 8 can be opposed to each other with the recording sheet P sandwiched therebetween.

Incidentally, when the detachable unit 11 is mounted on the main unit 10, as illustrated in FIGS. 3 and 21, the push button 100 sticking out of the upper surface 60*a* of the main frame 60 is pressed by the push protrusion 101 of the detachable unit 11 to move downward. Then, the push button 100 presses down the locking piece 96*a*, and hence, rotates the swinging plate 96 to the front side with a force against the coil spring 98. Thus, the first gear 91 rotates so as to move close to the second gear 92 together with the swinging plate 96, to thereby be meshed with the second gear 92 finally. This mesh is maintained as long as the detachable unit 11 is not separated from the main unit 10.

Accordingly, all the first gear 91, the second gear 92, and the third gear 93 are meshed with each other, and hence, the gear train mechanism for a movable blade 90 couples the drive gear 82 with the rack 81. This enables the rotational force of the drive gear 82 to be transmitted to the rack 81.

Next, the case of performing printing on the recording sheet P is described.

In this case, first, the platen motor is driven to rotate the platen roller 5. This allows the recording sheet P sandwiched between the platen roller 5 and the thermal head 6 to be fed forward, and simultaneously, the paper roll R mounted on the mounting board 2*b* rotates.

The thermal head 6 is operated at the same time. This causes a number of heat-generating elements to generate heat appropriately. As a result, various characters and graphics can be printed clearly on the fed recording sheet P. After that, the recording sheet P further fed by the platen roller 5 passes through between the fixed blade 9 and the movable blade 8.

Incidentally, even if an external force is applied from the recording sheet P, the thermal head 6, or the like to the platen roller 5 while printing is performed with the detachable unit 11 being combined with the main unit 10, the external force is unlikely to be transmitted to the engagement pin 50 and the lock pin 51 that are not coaxial to the platen shaft C. This can prevent the engagement pin 50 and the lock pin 51 from being detached from the first recess 65 and the second recess 66 due to the influence of the external force. Thus, the detachable unit 11 can be combined with the main unit 10 securely with high reliability. Therefore, the thermal head 6 and the platen roller 5 can be combined stably, and stable printing can be performed.

During mounting of the detachable unit 11, the lock pin 51 is unlikely to move in a direction in which the lock pin 51 is detached from the second recess 66 by the bias of the coil spring 52. Therefore, it is possible to prevent the lock pin 51 from being detached from the second recess 66 unintentionally, and to render the combination of the main unit 10 and the detachable unit 11 reliable.

In addition to the engagement pin 50 and the lock pin 51, the auxiliary pin 53 is fitted in the third recess 67. Therefore, the detachable unit 11 can be fixed at two places in the fore-and-aft directions L1 with respect to the main unit 10, and the detachable unit 11 and the main unit 10 can be combined more strongly. Therefore, even if some external force is applied to the detachable unit 11, looseness and the like are unlikely to occur. In this respect, stable printing can be performed.

Next, the case of cutting the recording sheet P after finishing printing is described.

In this case, the drive gear 82 is rotated by driving the movable blade motor 95. Then, as illustrated in FIG. 3, the rotational force is transmitted to the third gear 93 via the first gear 91 and the second gear 92 to rotate the third gear 93. This enables the rack 81 meshed with the third gear 93 to move linearly. Thus, the movable blade 8 can be slid upward to be directed to the fixed blade 9 via the movable blade holder 80 integrated with the rack 81 so that the state illustrated in FIGS. 10 and 19 is shifted to the state illustrated in FIGS. 9 and 18.

Then, as illustrated in FIG. 18, the slid movable blade 8 overlaps the fixed blade 9 as if the movable blade 8 rides on the fixed blade 9, and cuts the recording sheet P while sandwiching the recording sheet together with the fixed blade 9.

At this time, the movable blade 8 is formed in a substantially V-shape when viewed from above, and hence, comes into contact with the fixed blade 9 at two right and left points. Thus, the recording sheet P can be cut from both right and left sides to the center of the recording sheet along with the slide of the movable blade 8, and the recording sheet P can be cut satisfactorily without any bias. As a result, the cut piece of the recording sheet P can be used as a sales check, a ticket, or the like.

Incidentally, when the movable blade 8 rides on the fixed blade 9, the movable blade 8 tries to push the fixed blade 9 to the back side. However, as illustrated in FIG. 9, the fixed blade holder 16 supporting the fixed blade 9 is biased to the front side by the coil springs 40. Thus, the cutting edge 9*a* of the fixed blade 9 can be brought into press-contact with the cutting edge 8*a* of the movable blade 8 under an appropriate contacting pressure. Thus, a gap is unlikely to be formed between the cutting edge 9*a* of the fixed blade 9 and the cutting edge 8*a* of the movable blade 8, and thus, the recording sheet P can be cut with satisfactory sharpness.

Figure 22:
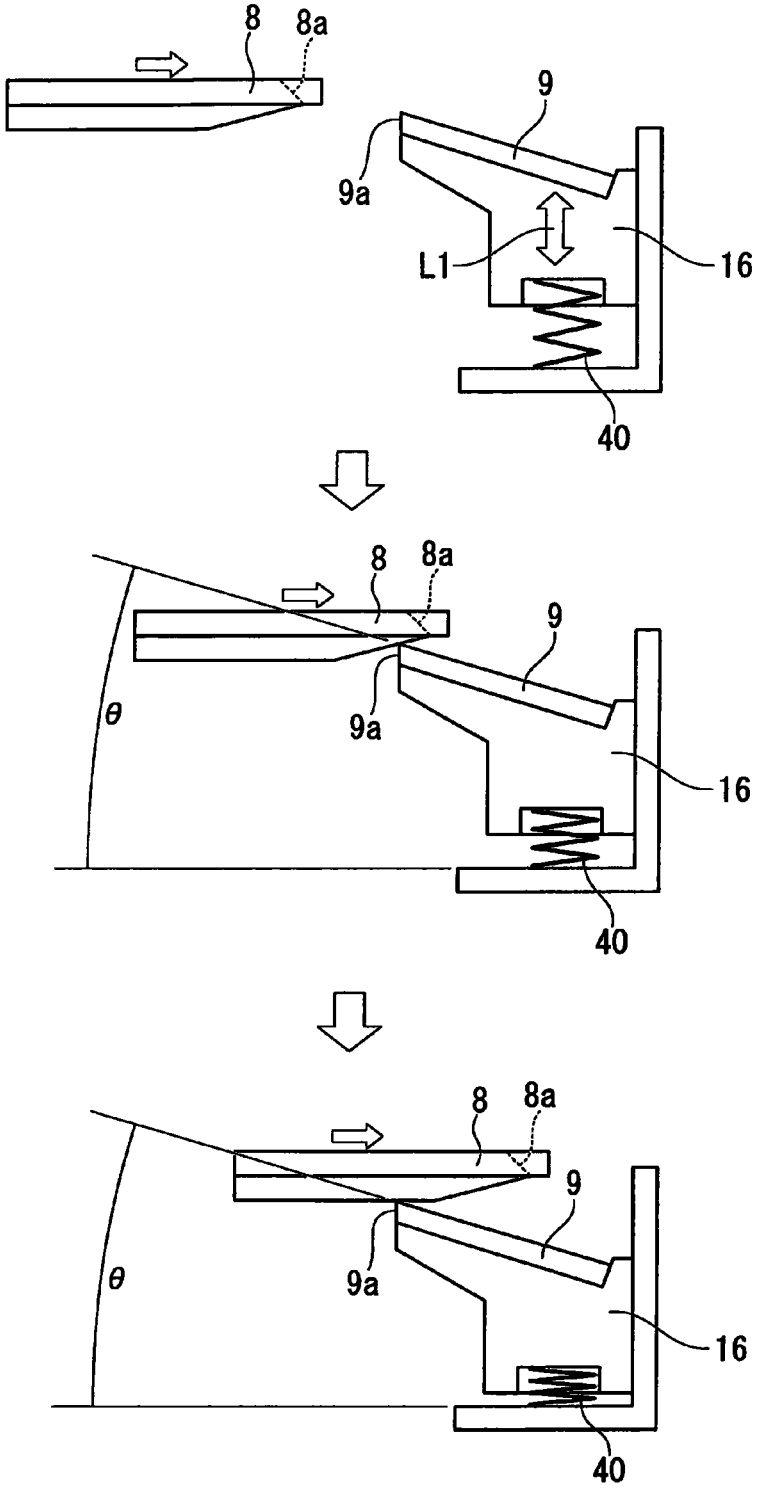
FIG. 22 is a schematic view illustrating how the movements of the movable blade and the fixed blade held by a fixed blade holder change along with the proceeding of the slide of the movable blade.

Further, unlike the conventional example in which a fixed blade is held so that a cutting edge thereof swings, the fixed blade 9 according to this embodiment is held by the fixed blade holder 16 that is supported so as to be movable in the orthogonal direction (fore-and-aft directions L1) by the holder support frame 17. Therefore, as illustrated in FIGS. 9 and 22, when the movable blade 8 starts riding on the fixed blade 9 gradually along with the slide, the fixed blade holder 16 moves in the orthogonal direction (fore-and-aft directions L1), i.e., moves to the back side accordingly. Thus, the inclined state of the fixed blade 9 can be maintained constantly with respect to the movable blade 8, that is, an angle formed by the cutting edge 9*a* of the fixed blade 9 with respect to the cutting edge 8*a* of the movable blade 8 can be continued to be kept at an optimum cutting angle θ, irrespective of the slide condition of the movable blade 8.

As a result, the recording sheet P can be cut while the optimum cutting angle θ is kept at all times from the beginning of cutting to the end of cutting. There is a low risk that cutting defects such as uncut portions occur in the recording sheet P, which enables satisfactory cutting to be performed stably.

FIG. 22 is a schematic view illustrating how the movements of the movable blade 8 and the fixed blade 9 held by the fixed blade holder 16 change along with the proceeding of the slide of the movable blade 8.

Further, the fixed blade holder 16 according to this embodiment is capable of not only moving in the orthogonal direction (fore-and-aft directions L1), but also swinging about the fixing screw 38, as illustrated in FIG. 12. Therefore, the fixed blade 9 held by the fixed blade holder 16 can swing in the blade width direction with a high degree of freedom. Therefore, the fixed blade 9 is allowed to follow the movement of the movable blade 8 by swinging the fixed blade 9 freely in the blade width direction in accordance with the behavior of the movable blade 8 from the beginning to the end of cutting. Consequently, the press-contact forces at the two right and left contact points can be easily well-balanced equally.

Thus, the recording sheet P can be cut from both the right and left sides thereof more reliably, and cutting defects can be rendered further unlikely to occur.

In particular, in the case of the cutter mechanism 4 of the type in which the movable blade 8 and the fixed blade 9 are separable as in this embodiment, it is considered that it is difficult to set the fixed blade 9 and the movable blade 8 at predetermined positions every time with good positional accuracy when the detachable unit 11 is combined with the main unit 10. Thus, the balance of the press-contact between the movable blade 8 and the fixed blade 9 is likely to be degraded, and in some cases, inconvenience such as the degradation in sharpness of one of the blades may be caused.

However, in the case of this embodiment, even if a shift is caused at set positions of the fixed blade 9 and the movable blade 8, the fixed blade 9 swings freely in the blade width direction with respect to the fixing screw 38 as described above, and hence, the press-contact forces at the two right and left contact points can be well-balanced equally. Thus, the risk that the above-mentioned inconvenience may occur can be decreased.

Next, the case where paper jam or the like occurs during printing, and the movable blade 8 is stopped halfway through sliding is described.

In this case, the movable blade 8 rides on (covers) the fixed blade 9. In this embodiment, the detachable unit 11 can be moved close to and away from the main unit 10 in the sliding direction (up-and-down directions L2) of the movable blade 8. Thus, even if the movable blade 8 is stopped halfway through sliding, the detachable unit 11 can be separated from the main unit 10, and the fixed blade 9 can be pulled out so as to be slid on the movable blade 8.

This point is described in detail.

First, after the lock mechanism is cancelled, the open/close door 3 is opened so as to be rotated to the back side about the hinge portion 7. Then, as illustrated in FIGS. 16 and 17, the release cover 20 attached to the inner surface of the open/close door 3 starts rotating to the back side about the axial line of the auxiliary pin 53 along with the opening operation of the open/close door 3. Therefore, the release cover 20 pushes up the lock pin 51 via the hook portion 20*c*.

Then, this force is transmitted to the latch cover 19 via the lock pin 51, and hence, the latch cover 19 rotates to the front side due to the force against the coil spring 52 about the axial line of the engagement pin 50. Thus, the lock pin 51 is detached from the second recess 66 along with the rotation of the latch cover 19. Consequently, the engagement pin 50 and the auxiliary pin 53 can move in the opening direction of the first recess 65 and the third recess 67.

After the engagement pin 50 and the auxiliary pin 53 move along the first recess 65 and the third recess 67 at the same timing along with further opening operation of the open/close door 3, the engagement pin 50 and the auxiliary pin 53 are detached from the first recess 65 and the third recess 67 completely. Thus, the detachable unit 11 can be disconnected from the main unit 10 and separated from each other. Then, the detachable unit 11 can be spaced largely from the main unit 10 by further opening the open/close door 3.

In particular, when the detachable unit 11 is separated, the detachable unit 11 moves as if the detachable unit 11 draws an arcuate path with respect to the hinge portion 7 together with the open/close door 3. Therefore, in the initial stage of separation, the detachable unit 11 moves in the sliding direction (up-and-down directions L2) of the movable blade 8. Thus, even when the movable blade 8 is stopped halfway through sliding and rides on the fixed blade 9 as illustrated in FIG. 9, the fixed blade 9 can be pulled out so as to be slid on the movable blade 8 as described above.

Accordingly, even in the case where the movable blade 8 is stopped halfway through sliding, the movable blade 8 and the fixed blade 9 can be separated from each other easily unlike the conventional example. Then, after opening the open/close door 3 largely, operations for recovery from various inconveniences such as paper jam can be performed immediately.

In particular, when the detachable unit 11 is separated from the main unit 10, the gear train mechanism for a movable blade 90 mechanically disconnects the drive gear 82 and the rack 81 from each other along with the separation. That is, the press-down of the push button 100 is released when the detachable unit 11 is separated. Therefore, as illustrated in FIG. 20, the swinging plate 96 is pulled by the coil spring 98 to rotate to the back side. Therefore, as illustrated in FIG. 4, the first gear 91 is moved away from the second gear 92, and the mesh therebetween is cancelled. As a result, the drive gear 82 is disconnected from the rack 81.

Thus, the rack 81 is placed in a free state to be not engaged with the movable blade motor 95. Then, as illustrated in FIG. 19, the movable blade holder 80 formed integrally with the rack 81 is pulled by the coil spring 83 to move downward. This can automatically restore the movable blade 8 at a standby position (initial position) before the slide, which can prevent the cutting edge 8*a* of the movable blade 8 from remaining sticking out at a time of separation of the detachable unit 11.

Accordingly, the operations for recovery from various inconveniences can be performed without taking special care to the movable blade 8, and thus, excellent safety is ensured. Further, as described above, the rack 81 is disconnected from the drive gear 82, and hence, the movable blade 8 does not move even if the movable blade motor 95 is driven by mistake (interlock mechanism). In this respect, high safety can be ensured.

As described above, the thermal printer 1 according to this embodiment can exhibit the following functional effects.

First, with only simple operations of fitting/detachment of the engagement pin 50 with respect to the first recess 65 and fitting/detachment of the lock pin 51 with respect to the second recess 66 due to the relative movement thereof to the engagement pin 50, the attachment/detachment operation of the detachable unit 11 can be performed smoothly. Thus, the main unit 10 and the detachable unit 11 can be combined quickly, or the combination thereof can be cancelled by separating the main unit 10 and the detachable unit 11 from each other quickly.

Further, unlike the case of using a conventional lock lever protruding largely outward, the detachable unit 11 is provided with the engagement pin 50, the lock pin 51, and the auxiliary pint 53 protruding slightly in a direction parallel to the platen shaft C. Thus, fingertips are unlikely to interfere with the attachment/detachment operation of the detachable unit 11, and the safety is more excellent compared with that of the conventional example.

Further, the engagement pin 50, the lock pin 51, and the auxiliary pin 53 are respectively fitted in the first recess 65, the second recess 66, and the third recess 67 formed in each of the opposed walls 62 of the main unit 10. Therefore, unlike the case of using a conventional lock lever, the size of the lateral width of the detachable unit 11 (lateral width along the platen shaft C) can be contained in an interval of the opposed walls 62. Thus, the entire thermal printer 1 can be miniaturized.

Further, even in the case where the movable blade 8 is stopped halfway through sliding, the main unit 10 and the detachable unit 11 can be separated from each other while the movable blade 8 is automatically restored to the original position, and in addition, the slide of the movable blade 8 that has been automatically restored can be regulated. Thus, excellent safety is ensured.

Further, due to the presence of the cutter mechanism 4 capable of maintaining the angle formed by the cutting edge 9*a* of the fixed blade 9 with respect to the cutting edge 8*a* of the movable blade 8 at the optimum cutting angle θ at all times and capable of allowing the fixed blade 9 to swing freely in the blade width direction to follow the movement of the movable blade 8, there is a low risk that cutting defects occur, and the recording sheet P can be cut satisfactorily. Consequently, the thermal printer 1 with enhanced reliability of cutting performance can be obtained. Further, the quality of the recording sheet P after being cut can be enhanced.

The technical range of the present invention is not limited to the above-mentioned embodiment, and can be modified variously within the range not exceeding the spirit of the present invention.

For example, in the above-mentioned embodiment, although the thermal printer 1 is described as an example of a printer, the printer is not limited to the thermal printer. For example, the printer may be an inkjet printer that performs printing on the recording sheet P using ink droplets, with a recording head serving as an inkjet head.

Further, in the above-mentioned embodiment, the thermal printer 1 is of a drop-in type in which the paper roll R is merely inserted to be placed on the mounting board 2*b*. However, the thermal printer of an axial support type may be used instead, in which an axial support mechanism axially supporting (rotatably supporting) the paper roll R is provided in the casing 2.

The casing 2 and the open/close door 3 are not indispensable components, and thus, may not be provided. That is, even only with the main unit 10 and the detachable unit 11, the printer functions sufficiently.

Further, in the above-mentioned embodiment, the platen roller 5 and the movable blade 8 are provided on the main unit 10 side, and the thermal head 6 and the fixed blade 9 are provided on the detachable unit 11 side. However, the thermal head 6 may be provided on the main unit 10 side and the platen roller 5 may be provided on the detachable unit 11 side.

It should be noted that, by providing the thermal head 6 and the fixed blade 9 whose configurations are simplified easily on the detachable unit 11 side, the detachable unit 11 can be miniaturized and reduced in weight, which is suitable for attachment/detachment operability.

Further, in the above-mentioned embodiment, the latch cover 19 is provided with the lock pin 51, and the lock pin 51 is allowed to rotate and move relative to the engagement pin 50 by rotating the latch cover 19. However, the present invention is not limited to this case. For example, the lock pin 51 may be moved relative to the engagement pin 50 by sliding the lock pin 51 linearly. Even in this case, similar functional effects can be exhibited.

With a simple configuration in which the latch cover 19 is merely rotated as in the above-mentioned embodiment, the lock pin 51 can be moved relative to the engagement pin 50. Thus, the configuration can be simplified and the parts count can be reduced.

Further, in the above-mentioned embodiment, when the detachable unit 11 is mounted on the main unit 10, the detachable unit 11 presses down the push button 100 to rotate the swinging plate 96, and the first gear 91 is meshed with the second gear 92. However, the push button 100 is not indispensable, and a protrusion member for rotating the swinging plate 96 may be provided directly on the detachable unit 11 side.

Further, in the above-mentioned embodiment, the rotational movement of the drive gear 82 is converted into the linear movement using the rack 81, and the movable blade holder 80 is reciprocated linearly. However, the reciprocating mechanism may be designed freely without being limited to the rack 81, as long as the movable blade holder 80 can be reciprocated linearly along with the rotation of the drive gear 82.

For example, such a reciprocating mechanism may be configured by adopting a rotation cam that rotates along with the rotation of the drive gear 82 and a generally well-known mechanism that allows the rotation of the rotation cam to reciprocate the movable blade holder 80 linearly.

Further, in the above-mentioned embodiment, by rotating the swinging plate 96 that axially supports the first gear 91, the rack 81 and the drive gear 82 are coupled to or disconnected from each other. However, the present invention is not limited to such a configuration.

The gear train mechanism for a movable blade 90 may be designed freely as long as the drive gear 82 and the rack 81 are coupled together when the detachable unit 11 is combined with the main unit 10, and the drive gear 82 is disconnected from the rack 81 when the detachable unit 11 is separated from the main unit 10.

Figure 23:
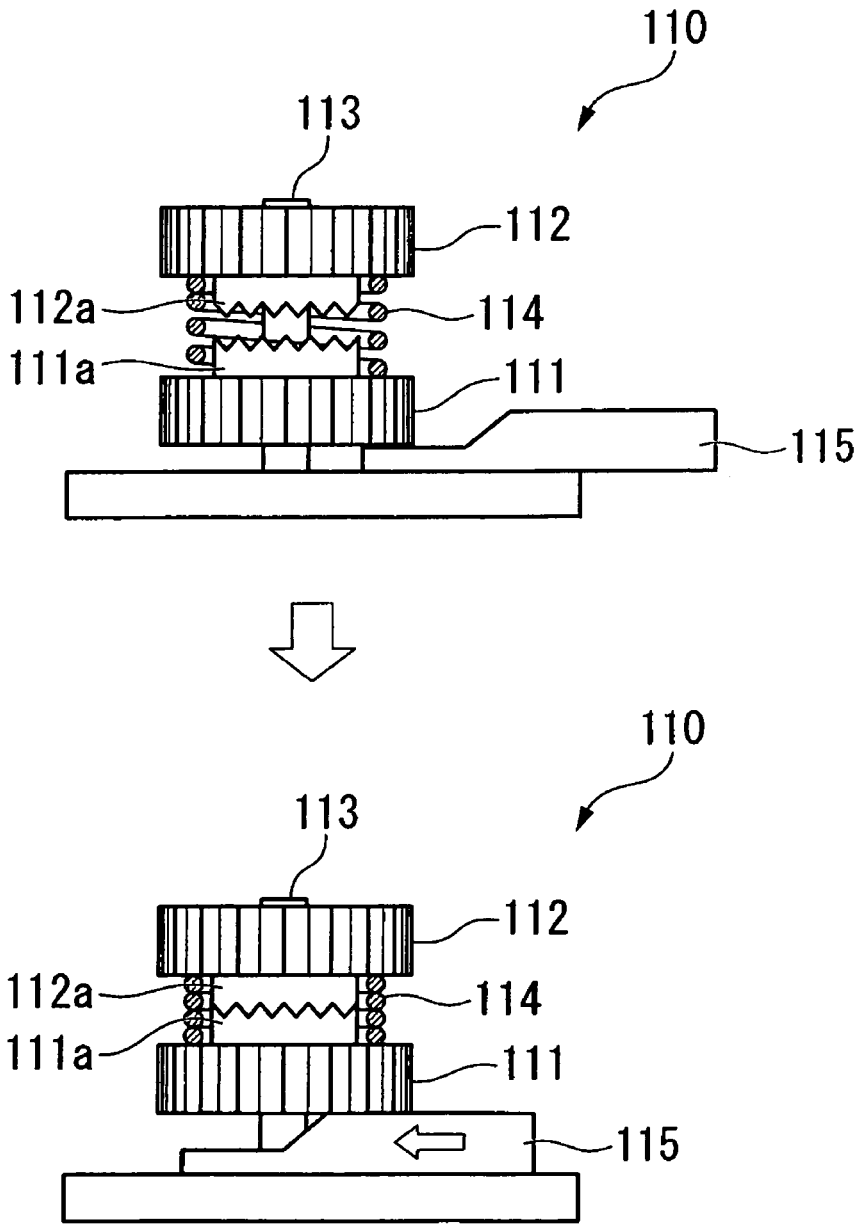
FIG. 23 is a view of a modification according to the present invention, illustrating another configuration of a gear train mechanism.

For example, as illustrated in FIG. 23, a gear train mechanism for a movable blade (gear train mechanism) 110 may be configured as follows: the gear train mechanism for a movable blade 110 includes an input gear 111 to be coupled to the drive gear 82 side and an output gear 112 to be coupled to the rack 81 side, and the input gear 111 is slid to be coupled to the output gear 112 by mounting of the detachable unit 11.

The above-mentioned case is described in detail.

The input gear 111 and the output gear 112 are axially supported by a common shaft core 113 while respective inner gears 111*a*, 112*a* are directed to the partner sides. In this case, the input gear 111 is slidable along the shaft core 113. Further, the shaft core 113 is externally provided with a coil spring 114 so that the coil spring 114 is interposed between the input gear 111 and the output gear 112 and biases both the gears 111, 112 so as to move the same away from each other. The input gear 111 is slid to the output gear 112 side by a link button 115 that is moved by mounting of the detachable unit 11, and allows the inner gear 111*a* to be meshed with the inner gear 112*a* of the output gear 112.

Even with such a configuration, the drive gear 82 and the rack 81 can be coupled together when the detachable unit 11 is combined with the main unit 10, and the drive gear 82 and the rack 81 can be disconnected from each other when the detachable unit 11 is separated from the main unit 10. Thus, similar functional effects can be exhibited.

Figure 24:
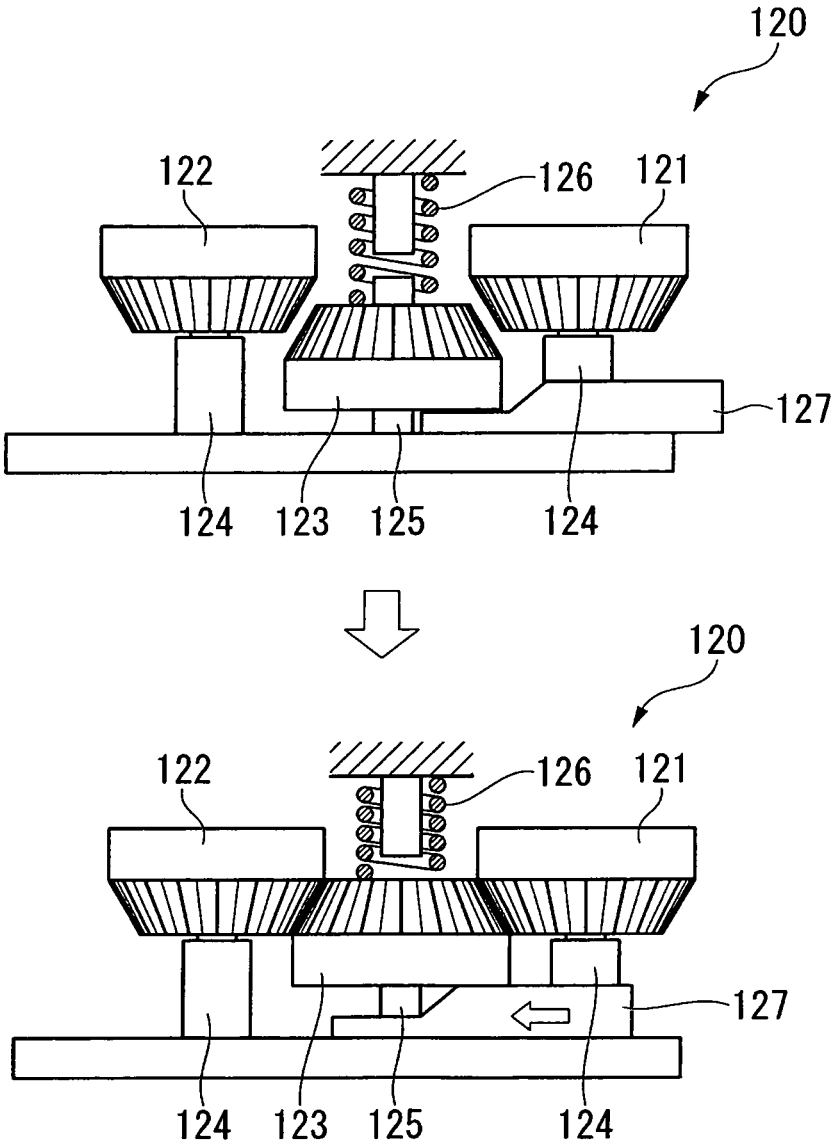
FIG. 24 is a view of a modification according to the present invention, illustrating still another configuration of the gear train mechanism.

Further, as another configuration, as illustrated in FIG. 24, the following may be adopted: a gear train mechanism for a movable blade (gear train mechanism) 120 includes an input gear 121 to be coupled to the drive gear 82 side, an output gear 122 to be coupled to the rack 81 side, and an intermediate gear 123 provided between the input gear 121 and the output gear 122, and the intermediate gear 123 is slid by mounting of the detachable unit 11 to couple the input gear 121 to the output gear 122.

The above-mentioned case is described in detail.

The input gear 121, the output gear 122, and the intermediate gear 123 are formed as bevel gears, and a shaft core 125 for the intermediate gear 123 is provided so as to be positioned between shaft cores 124 that axially support the input gear 121 and the output gear 122, respectively. In this case, the intermediate gear 123 is slidable along the shaft core 125. Further, the intermediate gear 123 is biased by a coil spring 126 so as to be moved away from the input gear 121 and the output gear 122. The intermediate gear 123 is slid against the coil spring 126 by a link button 127 moved by mounting of the detachable unit 11, and is meshed with both the input gear 121 and the output gear 122.

Even with such a configuration, the drive gear 82 and the rack 81 can be coupled to each other when the detachable unit 11 is combined with the main unit 10, and the drive gear 82 can be disconnected from the rack 81 when the detachable unit 11 is separated from the main unit 10. Thus, similar functional effects can be exhibited.

What is claimed is:

1. A printer in which a recording head and a platen roller are separably combined with each other, the printer comprising:

a main unit including a main frame supporting one of the recording head and the platen roller, the main unit having a front cover detachably attached to front and side wall portions of the main frame and having a pair of walls opposed to one another, each of the opposed walls being formed with a first recess and a second recess; and a detachable unit supporting the other of the recording head and the platen roller and being combined with the main unit so as to be attachable to and detachable from the main unit with the front cover remaining attached to the front and side wall portions of the main frame when the detachable unit is detached from the main unit, the detachable unit including:

an engagement pin protruding along an axial line which is non-coaxial and parallel with respect to a platen shaft of the platen roller, the engagement pin being configured to be detachably fitted in the first recess of each of the opposed walls of the main unit so that the recording head and the platen roller are opposed to each other in a contact state;

a lock pin protruding in a direction parallel to the engagement pin and being movable relative to the engagement pin in a virtual plane orthogonal to the platen shaft, the lock pin being configured to be detachably fitted in the second recess of each of the opposed walls of the main unit after the engagement pin is fitted in the first recess of each of the opposed walls;

a biasing member for biasing the lock pin in a direction of detachably fitting the lock pin into the second recess of each of the opposed walls;

a release member for moving the lock pin in a direction opposite to the direction in which the lock pin is biased by the biasing member to thereby detach the lock pin from the second recess of each of the opposed walls, the release member being positioned so as to not project from an upper surface of the detachable unit except during detachment of the detachable unit from the main unit; and a latch member mounted to undergo free rotational movement about the axial line of the engagement pin, the lock pin being formed integrally with the latch member for undergoing rotation therewith;

wherein the engagement pin is incapable of being detached from the first recess of each of the opposed walls when the lock pin is fitted in the second recess of each of the opposed walls, and is capable of being detached from the first recess of each of the opposed walls after the lock pin is detached from the second recess of each of the opposed walls.

2. A printer according to claim 1; wherein the detachable unit further comprises an auxiliary pin protruding in the direction parallel to the engagement pin; and wherein each the opposed walls of the main unit includes a third recess which is opened in the same direction as an opening direction of the first recess of each of the opposed walls, the auxiliary pin being configured to be detachably fitted in the third recess of each of the opposed walls.

3. A printer according to claim 1; wherein the detachable unit further comprises a head support frame supporting the recording head, a fixed blade disposed on a downstream side in a conveying direction of a recording sheet with respect to the recording head, a fixed blade holder supporting the fixed blade, and a holder support member movably supporting the fixed blade holder.

4. A printer according to claim 3; wherein the head support frame is pivotally mounted to the holder support member.

5. A printer according to claim 1; wherein the lock pin is separated by a predetermined distance from the axial line of the engagement pin and is mounted to undergo movement along an arcuate path about the axial line of the engagement pin.

6. A printer according to claim 1; wherein the main unit includes the platen roller, a movable blade anc a main frame supporting the platen roller and the movable blade.

7. A printer according to claim 1; wherein when the engagement pin and the lock pin are detachably fitted in the first recess and the second recess, respectively, of each of the opposed walls of the main unit, a part of an inner circumferential edge of the second recess of each of the opposed walls prevents the lock pin from moving in an opening direction of the first recess of each of the opposed walls.

8. A printer according to claim 1; wherein the detachable unit is configured to be detached from the main unit only when the engagement pin is detached from the first recess of each of the opposed walls after the lock pin is detached from the second recess of each of the opposed walls.

9. A printer comprising:

a first unit including a main frame supporting one of a recording head and a platen roller, the first unit having a front cover detachably attached to front and side wall portions of the main frame and having spaced wall portions each provided with a first recess and a second recess; and a second unit supporting the other of the recording head and the platen roller and being freely attachable to and detachable from the first unit with the front cover remaining attached to the front and side wall portions of the main frame when the second unit is detached from the first unit, the second unit comprising:

a pair of engagement pins configured to be detachably fitted in respective ones of the first recesses of the first unit so that the recording head and the platen roller are opposed to each other in a contact state;

a latch member mounted to undergo rotation about an axial line of the engagement pins and having a pair of lock pins for rotation therewith and configured to be detachably fitted in respective ones of the second recesses of the first unit after the engagement pins are fitted in the first recesses;

a biasing member for biasing the latch member in a first direction of detachably fitting the lock pins in the second recesses of the first unit; and a release member for moving the lock pins in a second direction opposite to the first direction to thereby detach the lock pins from the second recesses of the first unit, the release member being positioned so as to not project from an upper surface of the second unit except during detachment of the second unit from the first unit.

10. A printer according to claim 9; wherein the engagement pins, the lock pins and the first and second recesses are configured so that the engagement pins are prevented from being detached from the first recesses when the lock pins are fitted in the second recesses and so that the engagement pins are permitted to be detached from the first recesses after the lock pins are detached from the second recesses.

11. A printer according to claim 9; wherein the first unit is configured to be detached from the second unit only when the engagement pins are detached from the first recesses after the lock pins are detached from the second recesses.

12. A printer according to claim 9; wherein the engagement pins protrude along an axial line which is non-coaxial and parallel with respect to a platen shaft of the platen roller.

13. A printer according to claim 9; wherein the lock pins protrude in a direction parallel to the engagement pins and are movable relative to the engagement pins in a virtual plane orthogonal to the platen shaft.

14. A printer according to claim 9; wherein the spaced wall portions of the first unit have third recesses opening in the same direction as an opening direction of the first recesses; and wherein the second unit has a pair of auxiliary pins protruding in a direction parallel to the engagement pins and configured to be detachably fitted in respective ones of the third recesses of the first unit.

15. A printer comprising:

a first unit including a main frame supporting one of a recording head and a platen roller, the first unit having a front cover detachably attached to front and side wall portions of the main frame and having spaced wall portions each provided with a first recess and a second recess; and a second unit supporting the other of the recording head and the platen roller and being freely attachable to and detachable from the first unit with the front cover remaining attached to the front and side wall portions of the main frame when the second unit is detached from the first unit, the second unit comprising:

a pair of engagement pins configured to be detachably fitted in respective ones of the first recesses of the first unit so that the recording head and the platen roller are opposed to each other in a contact state;

a pair of lock pins configured to be detachably fitted in respective ones of the second recesses of the first unit so that the engagement pins are prevented from being detached from the first recesses when the lock pins are fitted in the second recesses and the engagement pins are permitted to be detached from the first recesses after the lock pins are detached from the second recesses to thereby permit the second unit to be detached from the first unit;

a biasing member for biasing the lock pins in a direction of detachably fitting the lock pins in the second recesses of the first unit;

a latch member mounted to undergo rotational movement about an axial line of the engagement pins, the lock pins being integral with the latch member for rotational movement therewith so that when the latch member undergoes rotational movement in a first direction about the axial line of the engagement pins after the engagement pins are fitted in the first recesses, the lock pins undergo rotational movement relative to the engagement pins and are fitted into the second recesses to prevent the engagement pins from being detached from the first recesses, and so that when the latch member undergoes rotational movement in a second direction opposite to the first direction, the lock pins are removed from the second recesses to permit the engagement pins to be detached from the first recesses to thereby permit the second unit to be detached from the first unit; and a release member for moving the lock pins in a direction opposite to the direction of bias of the biasing member to thereby detach the lock pins from the second recesses of the first unit, the release member being positioned so as to not project from an upper surface of the second unit except during detachment of the second unit from the first unit.

16. A printer according to claim 15; wherein the engagement pins protrude along an axial line which is non-coaxial and parallel with respect to a platen shaft of the platen roller.

17. A printer according to claim 15; wherein the lock pins protrude in a direction parallel to the engagement pins and are movable relative to the engagement pins in a virtual plane orthogonal to the platen shaft.

18. A printer according to claim 15; wherein the spaced wall portions of the first unit have third recesses opening in the same direction as an opening direction of the first recesses; and wherein the second unit has a pair of auxiliary pins protruding in a direction parallel to the engagement pins and configured to be detachably fitted in respective ones of the third recesses of the first unit when the engagement pins are fitted in the first recesses.

19. A printer according to claim 15; wherein the first unit further comprises a head support frame supporting the recording head, a fixed blade disposed on a downstream side in a conveying direction of a recording sheet with respect to the recording head, a fixed blade holder supporting the fixed blade, and a holder support member movably supporting the fixed blade holder.

* * * * *